US007021024B2

(12) United States Patent
Kari

(10) Patent No.: US 7,021,024 B2
(45) Date of Patent: Apr. 4, 2006

(54) CARTRIDGE INSERT WHICH FITS INTO A BOX

(75) Inventor: David F. Kari, Bensenville, IL (US)

(73) Assignee: Fidelity Container Corporation, Elk Grove Village, IL (US)

( * ) Notice: Subject to any disclaimer, the term of this patent is extended or adjusted under 35 U.S.C. 154(b) by 191 days.

(21) Appl. No.: 10/689,802

(22) Filed: Oct. 21, 2003

(65) Prior Publication Data

US 2004/0084349 A1 May 6, 2004

Related U.S. Application Data

(63) Continuation-in-part of application No. 09/921,091, filed on Aug. 2, 2001, now Pat. No. 6,685,025.

(51) Int. Cl.
*B65B 11/00* (2006.01)
*B65D 85/30* (2006.01)

(52) U.S. Cl. ..... 53/397; 206/583; 206/592; 206/485; 206/588; 206/590; 493/55; 493/68; 493/137

(58) Field of Classification Search ..... 493/55, 493/68, 69, 79, 116, 136, 137, 397, 405; 206/485, 588, 590, 592, 586, 583, 591, 594; 53/397

See application file for complete search history.

(56) References Cited

U.S. PATENT DOCUMENTS

| | | | | |
|---|---|---|---|---|
| 1,039,026 | A | 9/1912 | Carter | |
| 3,240,417 | A * | 3/1966 | Andreini | 206/562 |
| 3,291,365 | A * | 12/1966 | Koene | 206/590 |
| 3,330,465 | A * | 7/1967 | Davidson et al. | 206/485 |
| 3,764,004 | A * | 10/1973 | Forbes, Jr. | 206/783 |
| 3,921,890 | A | 11/1975 | Relhim | |
| 4,320,839 | A * | 3/1982 | Skaggs | 206/591 |
| 5,322,168 | A * | 6/1994 | Kataoka | 206/588 |
| 5,458,237 | A * | 10/1995 | Kataoka | 493/162 |
| 5,467,875 | A | 11/1995 | Sato | |
| 5,772,025 | A | 6/1998 | Chen et al. | |
| 5,871,147 | A * | 2/1999 | Smith et al. | 206/485 |
| 5,979,659 | A | 11/1999 | Kataoka | |
| 6,199,700 | B1 * | 3/2001 | Yamamoto et al. | 206/586 |
| 6,257,412 | B1 | 7/2001 | Yamamoto et al. | |
| 6,308,828 | B1 | 10/2001 | Jones | |
| 6,685,026 | B1 * | 2/2004 | Hanna | 206/592 |

* cited by examiner

*Primary Examiner*—Stephen F. Gerrity
(74) *Attorney, Agent, or Firm*—Trexler, Bushnell, Giangiorgi, Blackstone & Marr, Ltd.

(57) ABSTRACT

An integral, generally rectangular corrugated fibreboard blank folds to form an insert having three air cells for cradling and protecting a product. Two of the air cells stand vertically with the third air cell suspended between them. A product rests on the third air cell and is received and captured between the vertical air cells. The insert, with the product in place, fits into a box where tabs projecting from the insert cooperates with the box to form two more air cells at the opposite ends of the insert.

41 Claims, 17 Drawing Sheets

CARTRIDGE INSERT WHICH FITS INTO A BOX

CROSS-REFERENCE

This application is a Continuation-in-Part of Ser. No. 09/921,091, entitled "Cartridge Insert Which Fits Into A Box" and filed Aug. 2, 2001, which issued as U.S. Pat. No. 6,685,025 on Feb. 3, 2004.

BACKGROUND OF THE INVENTION

This invention relates to corrugated fibreboard inserts which fit into a carton to receive and protect an elongated or generally rectangular product and more particularly—but not exclusively—to inserts which can accommodate toner or similar cartridges having any of a number of different configurations.

In general, the invention is directed to packaging elongated or generally rectangular products. A moment's thought will readily bring to mind many such products such as a VCR cartridge, a glass ornament, a work of art, a portable radio, or the like. For convenience of description, all of these and other objects will hereinafter be included in the term "toner cartridge" for a computer printer.

Some fields of a product have parts which are very similar and yet are also different in detail. This means that the manufacturer of that product has often been required to inventory a different packaging system for each product in the field. This need not only increases costs for warehousing, handling, and the like, but also creates inefficiencies because the correct box may not always be available or may be in the wrong place at the wrong time.

A toner cartridge is an example of such a product. There are many manufacturers of printers which use toners in cartridges of its own design. Each manufacturer may also have a variety of toner cartridges which have evolved with improvements over the years. The same toner manufacturer may supply toner for most, if not all of these cartridges, for printers of different manufacturers. Therefore, that toner manufacturer will want to minimize the types and styles of packaging materials which it must keep in inventory, despite the fact that each printer manufacturer has its own design. The problem is further complicated since a toner cartridge does not have the smooth configuration of a rectangular box, such as a VCR cartridge.

Another consideration is the type of packaging material insofar as its bulk, ease of use, disposition and the like. For example, one type of packaging material is either molded pulp or polystyrene foam that is molded in a shape which receives and cradles a toner cartridge. Also, this requires mold tooling. It is particularly inefficient since the molded shape may not receive essentially the same cartridge if this surface contour is changed without altering the overall outer dimensions. This type of molded packaging is bulky and is costly to store and transport since it amounts to storing and shipping air. Further, it creates bulky trash for the customer to discard. In the case of polystyrene, the material is not recyclable or environment friendly.

A desirable form of packaging is a corrugated fibreboard insert because it is inexpensive, and can be stored flat to take up a minimum amount of room. It is recyclable and environmentally friendly. Such an insert should be simple, easy to fold, and to interlock into place with a minimum amount of effort. Also, it should be easy for the customer to unfold and to discard it after it has done its job. Further, it should be versatile and equally easy to form and use any blank for any of many types of cartridge that may be fitted therein.

When the corrugated fibreboard blank is designed, it should use as small an amount of fibreboard as possible considering the need to physically protect the product. It should have reliable interlocking parts or other means to keep it in an assembled condition.

OBJECTS AND SUMMARY OF THE INVENTION

A primary object of the invention is to provide a multipurpose environmental friendly, insert which may receive and protect any one of a plurality of toner or other cartridges—or similar products—with equal protection and ease of use.

Briefly, and in accordance with the foregoing, the present invention discloses a corrugated fibreboard blank for receiving and protecting products, such as a toner cartridge, which is designed to securely receive the products in an upright position. The product may be either wrapped or unwrapped. Different types and sizes of product may be received and protected by the way that the blank is folded before or during an insertion of the product.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENTS

Figure 1:
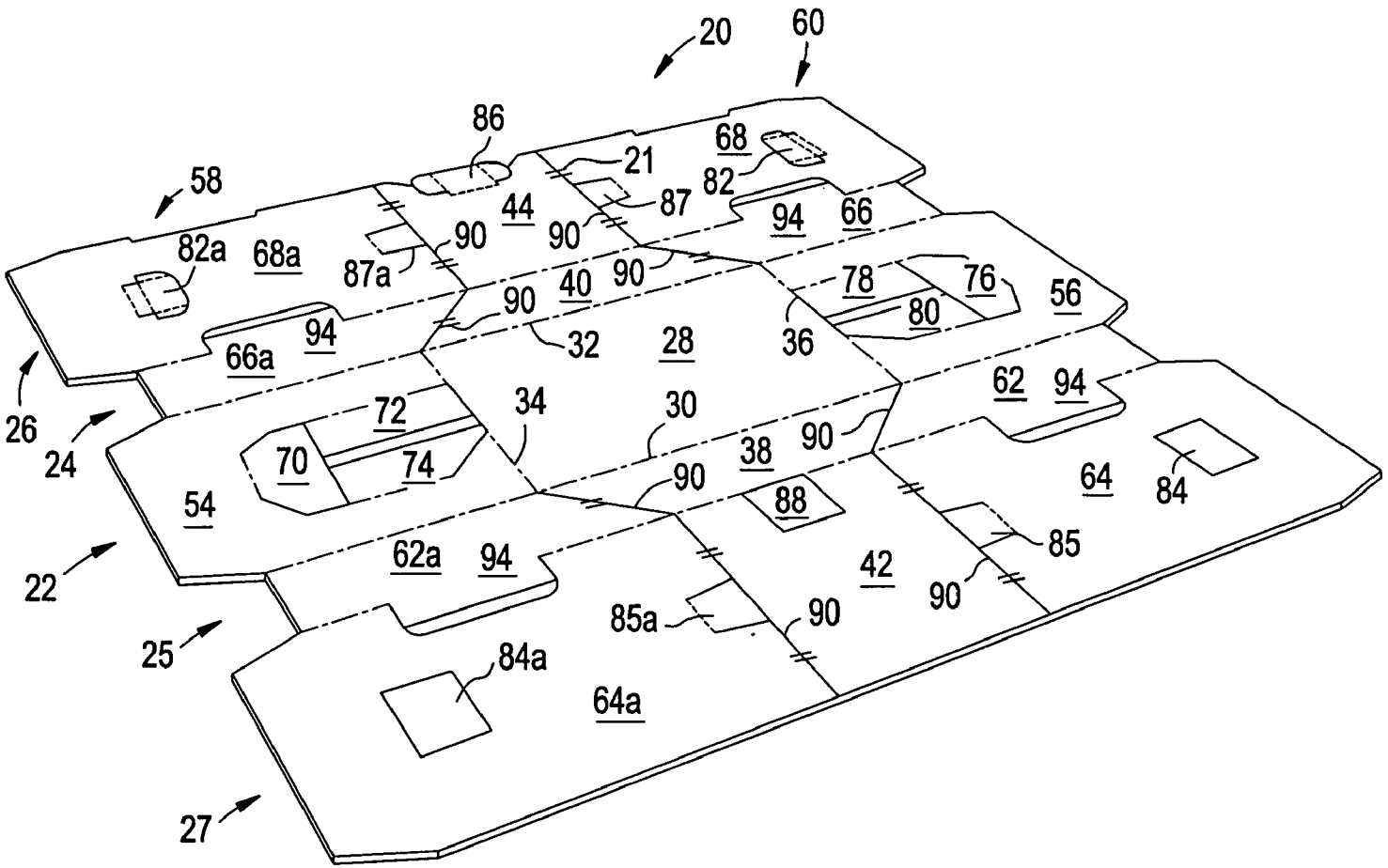
FIG. 1 is a perspective view of a corrugated fibreboard blank which is used for the formation of the insert of a first embodiment of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

A first embodiment of the invention is illustrated in FIGS. 1–8. A second embodiment of the invention is illustrated in FIGS. 9A–9F. A third embodiment of the invention is illustrated in FIGS. 10A–10E. Like elements are denoted with like reference numerals with the first embodiment being in the tens and one hundreds, the second embodiment being in the two and three hundreds, and the third embodiment being in the four and five hundreds.

Attention is invited to the first embodiment of the invention which is directed to a corrugated fibreboard blank 20 (FIG. 1) which may be folded to form an insert for receiving and protecting a product. Dot-dashed lines show where the blank 20 folds. Solid lines show where the blank 20 is cut. Hash marks, such as shown at 21, identify lines which are partially or almost cut through, as by knicked knives, so that they will initially fold as a unit, but will break apart when the blank 20 reaches a final fold. These partially cut lines 21 divide the blank 20 into three parts which will become a central air cell having a cradle air cell on each end.

A generally rectangular and integrally formed blank 20 is divided longitudinally into a bottom panel 22 flanked by side panels 24, 25 joined to outer panels 26, 27. The bottom panel 22 has a rectangular central bottom panel 28 with opposite sides at fold lines 30, 32 and ends 34, 36. The side panels 24, 25 have splayed panels 38, 40 joined to central bottom panel 28.

The side panels 24, 25 are joined to outer panels 26, 27 which have bottom air cell panels 42, 44 joined to splayed panels 38, 40. The splayed panels 38, 40 and bottom air cell panels 42, 44 will fold to form an air cell below central bottom panel 28.

A central cradle panel 54, 56 is formed at each end of the central bottom panel 28. The side panels 24, 25 and the outer panels 26, 27 have intermediate and outer cradle panels 62, 64 and 66, 68, respectively, which fold to form an air cell behind the central cradle panels 54, 56. Similar cradle panels (identified by the suffix (a)) are formed on the opposite ends of outer panels 26, 27. Therefore, air cells are formed on each end and at the bottom of the insert formed by blank 20. Product anchoring tabs 70, 72, 74, 76, 78, 80 are formed on the central cradle panels 54, 56.

The intermediate cradle panels 62, 66 and the outer cradle panels 64, 68 will fold to form an air cell behind the central cradle panels 54, 56. In greater detail, outer cradle panels 64, 68 fold and are positioned parallel to, behind, and spaced from central cradle panel 56. Outer cradle panels 64 and 68 are in face to face contact at which time, they are locked together when tab 82 is pushed through hole 84 and when somewhat keystone shaped tabs 85, 87 are bent into the air cell. The tab 82 has a somewhat mushroom shape to provide a handle for two fingers after it is pushed into hole 84.

The splayed panels 38, 40 and their bottom air cell panels 42, 44 are separated from intermediate cradle panels 62, 66 and from their outer cradle panels 64, 68 by lines 90 which are partially cut by knicked knives, as indicated by twin hash marks such as those shown at 21. That is to say, the corrugated fibreboard is almost, but not quite, cut through.

Three product anchor flaps 70, 72, 74 and 76, 78, 80 are formed in the central cradle panels 54, 56 on opposite ends 58, 60 of the bottom panel 22. Preferably, these anchor flaps 70, 72, 74, 76, 78, 80 have irregular shape in order to accommodate different end profiles of the product packaged in the cartridge insert. In greater detail, these flaps 70, 72, 74, 76, 78, 80 push out to receive and hold lower corners of the product. The opposite ends of the outer panel 26 have locking tabs 82, 82*a* which fit into holes 84, 84*a*, respectively, of the outer panel 27 in order to lock the formed air cell in place. By a selection of these irregular shapes, it is possible to design one insert to receive, for instance, three different cartridges.

Figure 2:
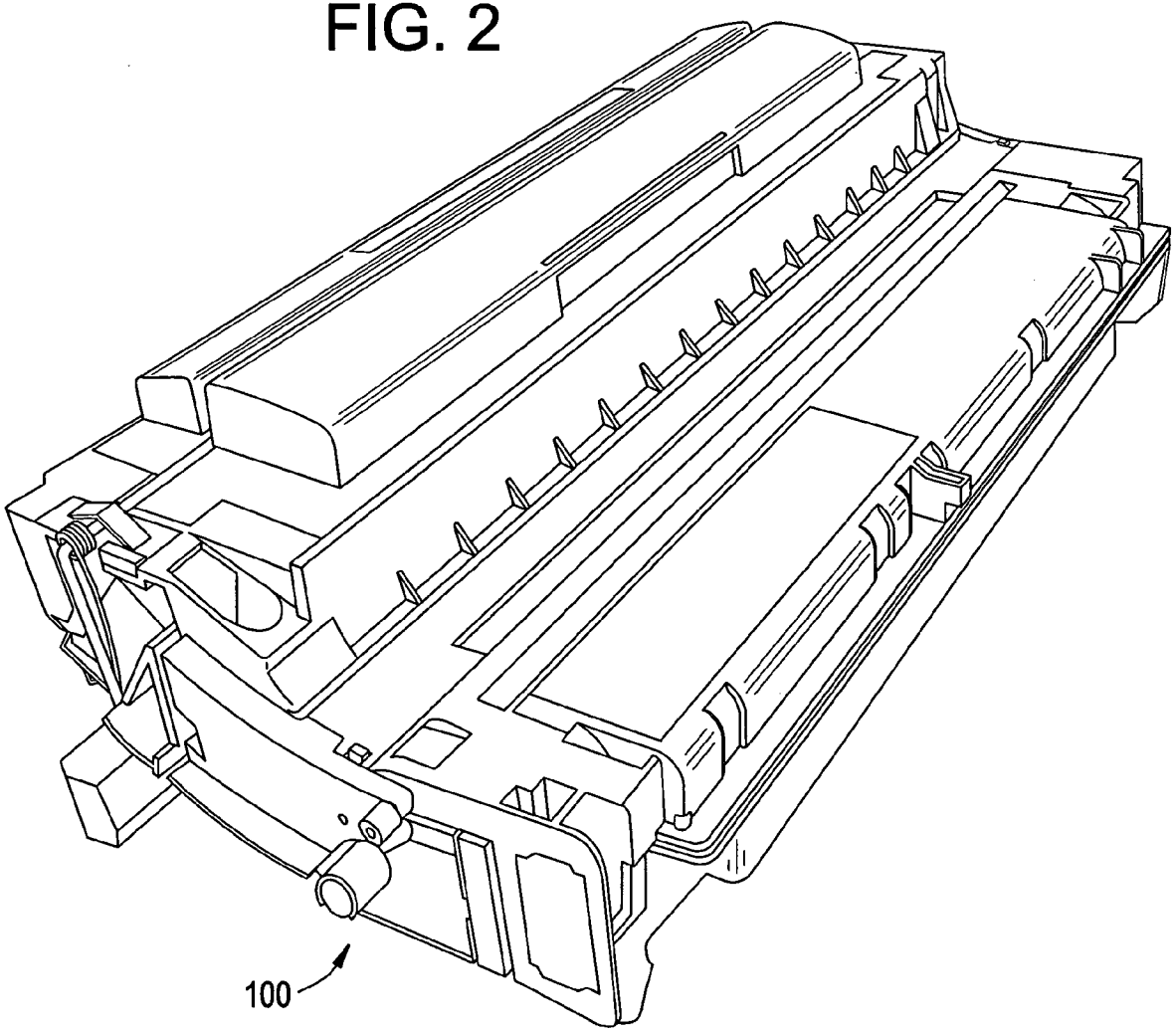
FIG. 2 is a perspective view of a toner cartridge.

FIG. 2 shows a product 100 (here shown by way of example as a toner cartridge). However, any product having a similar corner configuration may be cradled by the inventive cartridge insert. This is different from packing the product in a molded pulp or foam cradle which depends upon a cavity having the surface configuration of the product. The important feature in showing FIG. 2 is that the product 100 has complex outside contours which can be protected without reference to these contours. The outside dimensions of the product 100, not the surface configuration, determines the characteristics which enable a use of the inventive insert.

Figure 3C:
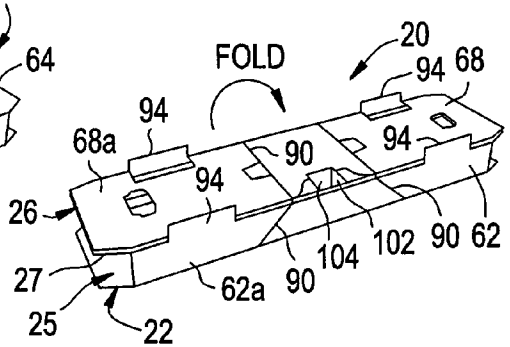
FIGS. 3A–3F are stop motion illustrating how the corrugated fibreboard blank of FIG. 1 is folded to form the insert of the first embodiment of the invention.
Figure 3B:
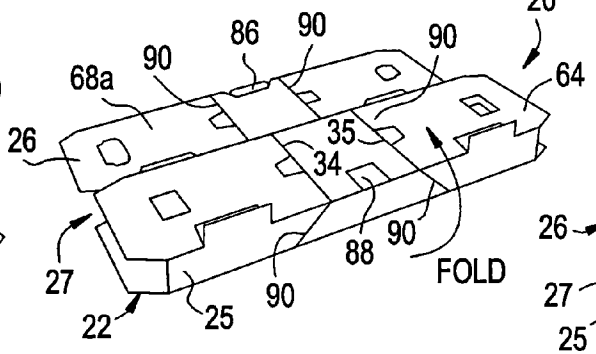
Figure 3A:
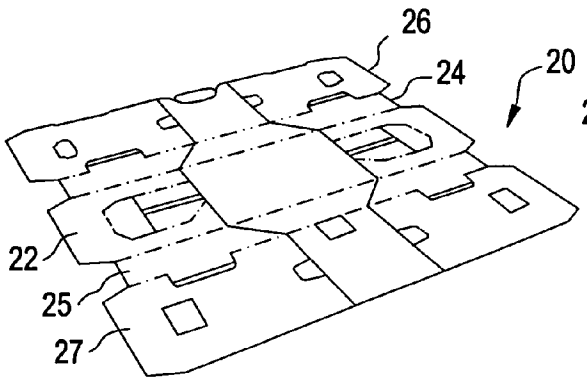

The use of blank 20 (FIG. 3A) begins with FIG. 3B which is a first step where side panel 25 is folded to stand perpendicular to bottom panel 22. Then, outer panel 27 is folded to be parallel to bottom panel 22 and perpendicular to side panel 25.

In FIG. 3C, the side panel 24 (not seen in FIG. 3C) is folded to stand perpendicular to bottom panel 22. Outer panel 26 is folded to be perpendicular to side panel 24, parallel to and in face-to-face contact with outer panel 27 (see also FIG. 3B). Locking tab 86 is pushed into locking hole 88 to secure the blank 20 in the folded configuration of FIG. 3C. The resulting structure is a generally tubular shaped structure.

It should be noted that the spacer tabs 94 are upstanding and have not folded over with the folding of the center panels 26, 27. It should also be noted that the lines 90 which were cut partially through by a knicked knife have held together so that the panels 22–27 folded as a unit and did not break apart through the folding of FIGS. 3B and 3C.

Figure 3F:
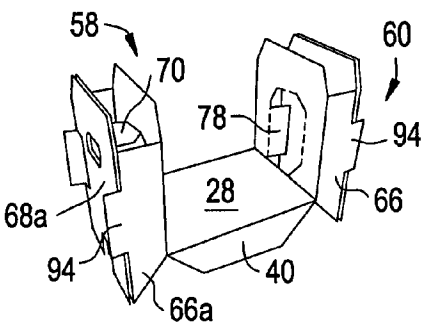
Figure 3E:
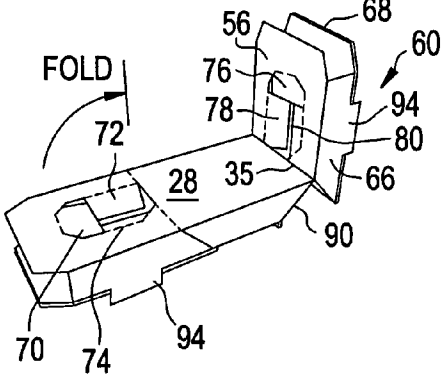
Figure 3D:
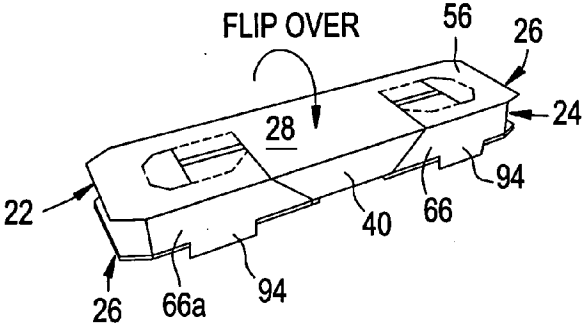

In FIG. 3D, the blank folded in FIG. 3C is flipped over so that bottom panel 22 is on top and outer panel 26 is on the bottom. Then (FIG. 3E), the end 60 is folded up. The lines 90 partially cut by knicked knives were strong enough to remain intact during the folding and flipping of FIGS. 3B–3D, but are not strong enough to resist the folding of the air cell at end 60.

Figure 4:
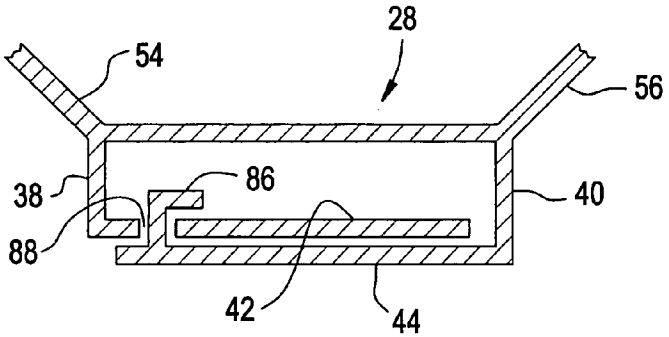
FIG. 4 is a cross section of an air cell at a bottom of the insert of the first embodiment of the invention.

In FIG. 3F, the folding is complete when the air cell at end 58 is folded and standing approximately perpendicular to center bottom panel 28 and parallel to the air cell at end 60. As can be seen in FIG. 3F, the insert is a generally U-shaped structure when in its final form. The product anchor tabs 70–80 are pushed in, and ready to receive the product. FIG. 4 is a cross-section of the air cell beneath the center bottom panel 28 which shows the locking tab 86 pressed through locking hole 88 in order to lock panels 42, 44 in an assembled position.

Figure 5:
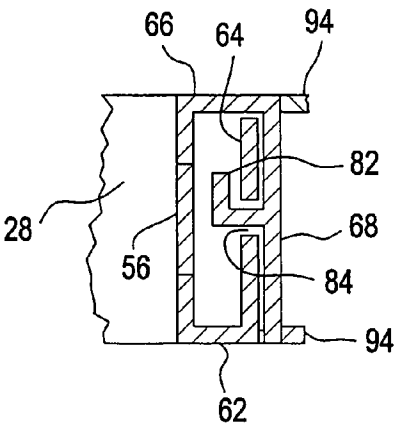
FIG. 5 is a cross section of an air cell at an end of the insert of the first embodiment of the invention.

FIG. 5 is a cross section of the air cell formed between central cradle cell 56 and outer cradle panel 68 which shows locking tab 82 pressed through locking hole 84 to lock panels 64, 68 together.

Figure 6:
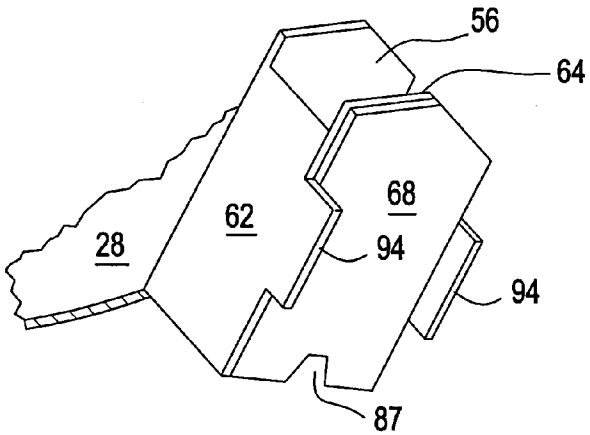
FIG. 6 is a perspective view showing an end air cell of the insert of the first embodiment of the invention.

An air cell (FIG. 6) is formed on each end of the insert formed by folded blank 20. The bottom edges of panels 68,

64 and 68*a*, 64*a* are locked together by pushing somewhat keystone shaped panels 85, 87 and 85*a*, 87*a* inwardly (FIG. 6).

After the air cells are formed on each of the opposite ends and the bottom of the insert, the product 100 (FIG. 7) is placed on the bottom panel 28 and between the product anchor flaps 70, 72, 74 and 76, 78, 80. As the end air cells are brought together, the lower corners of the product 100 are captured as they force the anchor flaps 70–74 and 76–80 outwardly.

For toner cartridges, enclosure within a plastic bag is required by the cartridge manufacturers to avoid problems relating to the possibility of spilling ink. A plastic bag is not necessary for packaging a different type of product, which has no spillage possible.

Preferably, the toner cartridge is placed inside a plastic bag 130 (FIG. 7) when the packaging is complete. The assembled insert and product 100 is now ready to be slid or placed in an outer box or carton.

Figure 8:
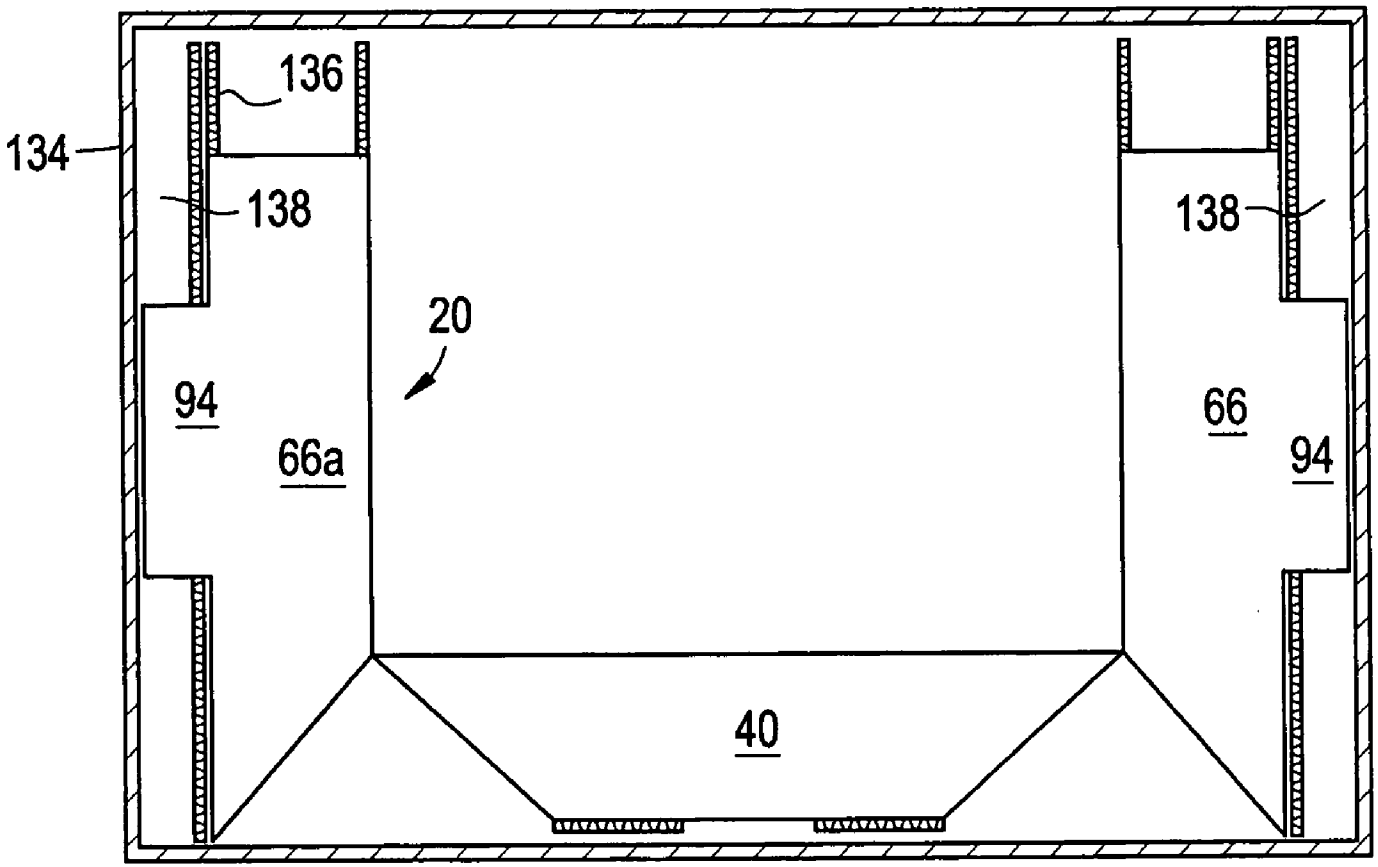
FIG. 8 is a cross section of the insert of the first embodiment of the invention inside a box.

It should be apparent from a study of FIG. 8 that cartridges having different configurations may be accommodated since there is nothing dedicating the cartridge to specific surface shapes. Therefore, one insert may serve a family of different cartridges. In an acceptable size, the insert will be held in place by the carton or box in which the insert is used.

FIG. 8 shows a completely folded insert 20 inside an outer box or carton 134. Edges where flutes of the corrugated fibreboard may be seen are indicated, as at 136, for example. As the panels 64, 68 fold to be perpendicular to panels 62, 66, a spacer tab 94 projects outwardly as shown on panels 62, 62*a* (FIG. 3C), for example, on each side and each end of the air cell. When the insert is placed inside a box 116 or carton 134, these spacer tabs 94 rest against the inside end surfaces of the box 134, thereby forming another air cell 138 to protect the product. The splayed panel 40 of the bottom air cell is in the nature of a bridge suspended between the vertical cradle air cells identified by their side panels 66*a*, 66.

Figure 7:
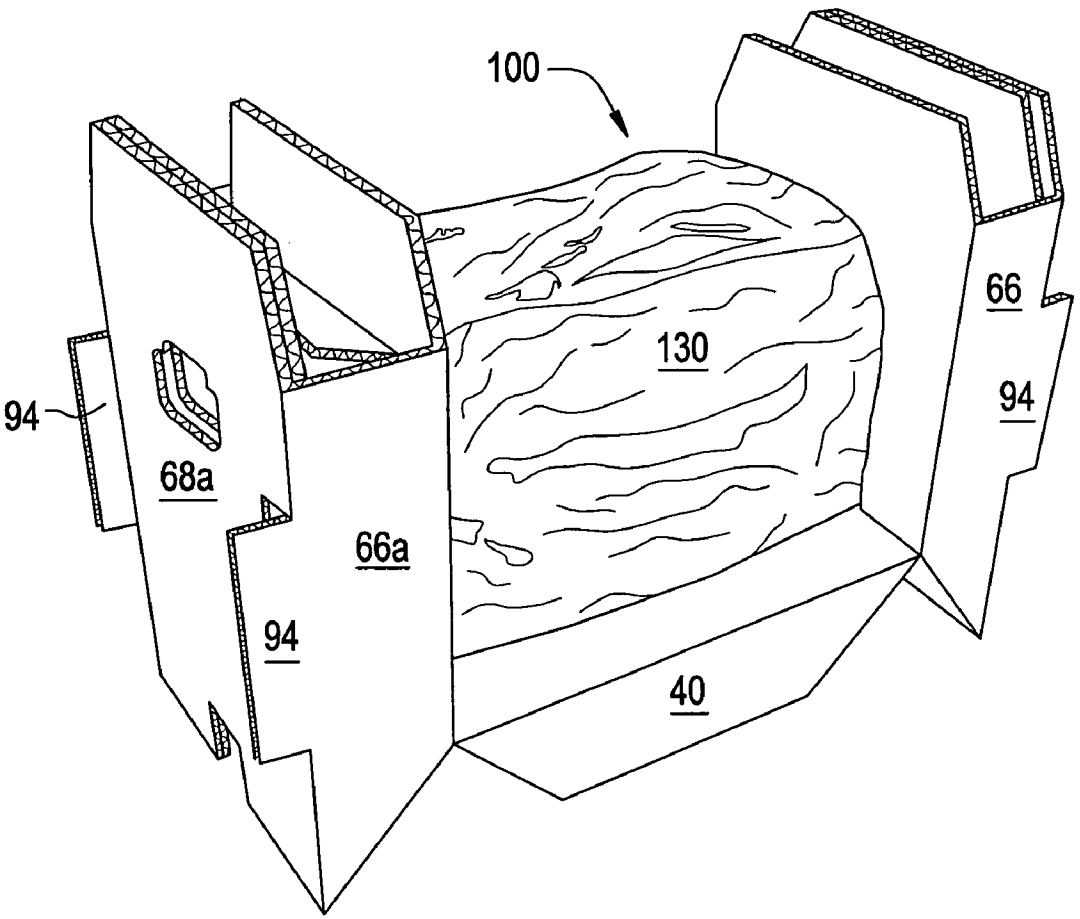
FIG. 7 is a perspective drawing of a complete insert of the first embodiment of the invention with a plastic wrapped cartridge in place in the insert.

As shown in FIGS. 6, 7 and 8, the insert 20 is positioned to receive and cradle a product of a medium length. This particular insert fits three different cartridges of similar length, but different profiles. If the cartridge is longer or shorter, it requires a longer or shorter insert. Normally, cartridges come grouped in similar lengths.

The product anchoring tabs 70–80 (FIG. 1) provide enough relief at the bottom of the product 100 to accept a product of any suitable length which the insert can accommodate.

Attention is invited to the second embodiment of the invention which is directed to a corrugated fibreboard blank 220 (FIG. 9A) which may be folded to form an insert 310 for receiving and protecting a product 100. Dot-dashed lines show where the blank 220 folds. Solid lines show where the blank 220 is cut. Hash marks, such as shown at 221, identify lines which are partially or almost cut through, as by knicked knives, so that they will initially fold as a unit, but will break apart when the blank 220 reaches a final fold. These partially cut lines 221 divide the blank 220 into three parts which will become a central air cell having a cradle air cell on each end.

A generally rectangular and integrally formed blank 220 is divided longitudinally into a bottom panel 222 flanked by side panels 224, 225 joined to outer panels 226, 227. The bottom panel 222 has a rectangular central bottom panel 228 with opposite sides at fold lines 230, 232 and ends 234, 236. The side panels 224, 225 have splayed panels 238, 240 joined to the central bottom panel 228.

The central bottom panel 228 has a panel 292 provided therein which is defined by solid lines 294*a*, 294*b*, 294*c*, which as defined above is where the blank 220 is cut, and by a dot-dashed line 296, which as defined above is where the blank 220 is folded. The solid line 294*a* is provided along a portion of the fold line 230 and solid line 294*c* is provided along a portion of the fold line 232. The solid line 294*b* extends from one end of the solid line 294*a* to one end of the solid line 294*c*. The dot-dashed line 296 extends from an opposite end of the solid line 294*a* to an opposite end of the solid line 294*c*. The solid line 294*b* further defines a tab portion 298 of the panel 292. The purpose of the panel 292 and of the tab portion 298 of the panel 292 will be discussed further herein in connection with the formation of the insert 310 of the second embodiment from the blank 220.

The side panels 224, 225 are joined to the outer panels 226, 227 which have bottom air cell panels 242, 244 joined to the splayed panels 238, 240. The splayed panels 238, 240 and the bottom air cell panels 242, 244 will fold to form an air cell below the central bottom panel 228. The bottom air cell panel 242 has a hole 243 provided therethrough. The hole 243 is sized and positioned such that upon formation of the insert 310 of the second embodiment, the hole 243 can receive and lock the tab portion 298 of the panel 292 therein in order to hold the panel 292 in place, as will be discussed further herein.

A central cradle panel 254, 256 is formed at each end of the central bottom panel 228. The side panels 224, 225 and the outer panel 226, 227 have intermediate and outer cradle panels 262, 264 and 266, 268, respectively, which fold to form an air cell behind the central cradle panels 254, 256. Similar cradle panels (identified by the suffix (a)) are formed on the opposite ends of the outer panels 226, 227. Therefore, air cells are formed on each end and at the bottom of the insert formed by blank 220. Product anchoring tabs or flaps 270, 272, 274, 276, 278, 280 are formed on the central cradle panels 254, 256.

The intermediate cradle panels 262, 266 and the outer cradle panels 264, 268 will fold to form an air cell behind the central cradle panels 254, 256. In greater detail, the outer cradle panels 264, 268 fold and are positioned parallel to, behind, and spaced from the central cradle panel 256. The outer cradle panels 264, 268 are in face to face contact at which time, they are locked together when tab 282 is pushed through hole 284 and when somewhat keystone shaped tabs 285, 287 are bent into the air cell. The tab 282 has a somewhat mushroom shape to provide a handle for two fingers after it is pushed into hole 284.

The splayed panels 238, 240 and their bottom air cell panels 242, 244 are separated from the intermediate cradle panels 262, 266 and from their outer cradle panels 264, 268 by lines 290 which are partially cut by knicked knives, as indicated by twin hash marks such as those shown at 221. That is to say, the corrugated fibreboard is almost, but not quite, cut through.

Three product anchor flaps or tabs 270, 272, 274 and 276, 278, 280 are formed in the central cradle panels 254, 256 on opposite ends 258, 260 of the bottom panel 222. Preferably, these anchor flaps 270, 272, 274, 276, 278, 280 have an irregular shape in order to accommodate different end profiles of the product packaged in the cartridge insert. In greater detail, these flaps 270, 272, 274, 276, 278, 280 push out to receive and hold lower corners of the product 100. The opposite ends of the outer panel 226 have locking tabs 282, 282*a* which fit into holes 284, 284*a*, respectively, of the outer panel 227 in order to lock the formed air cell in place.

By a selection of these irregular shapes, it is possible to design one insert to receive, for instance, three different cartridges.

Figure 9A:
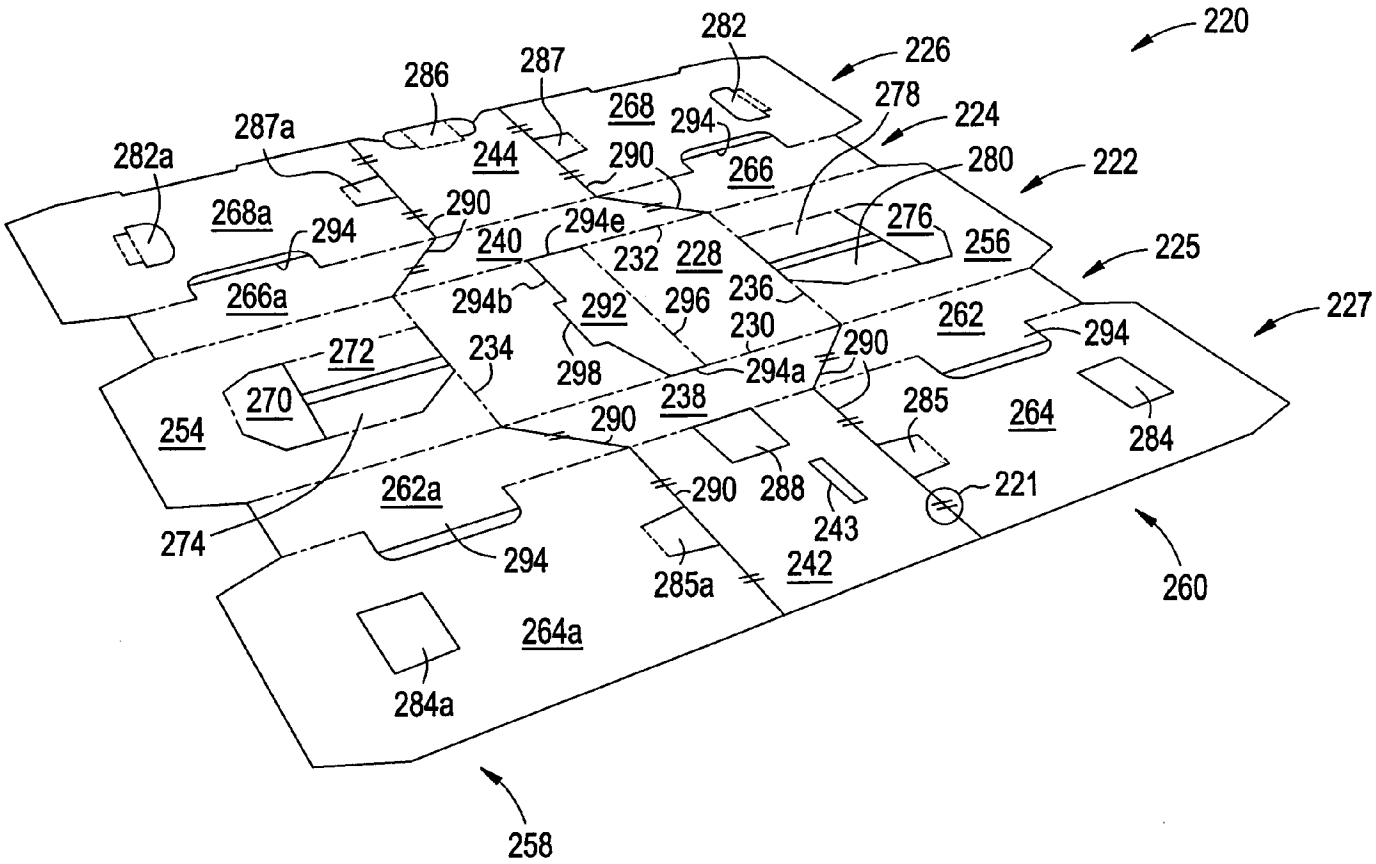
FIG. 9A is a perspective view of a corrugated fibreboard blank which is used for the formation of the insert of a second embodiment of the invention.
Figure 9B:
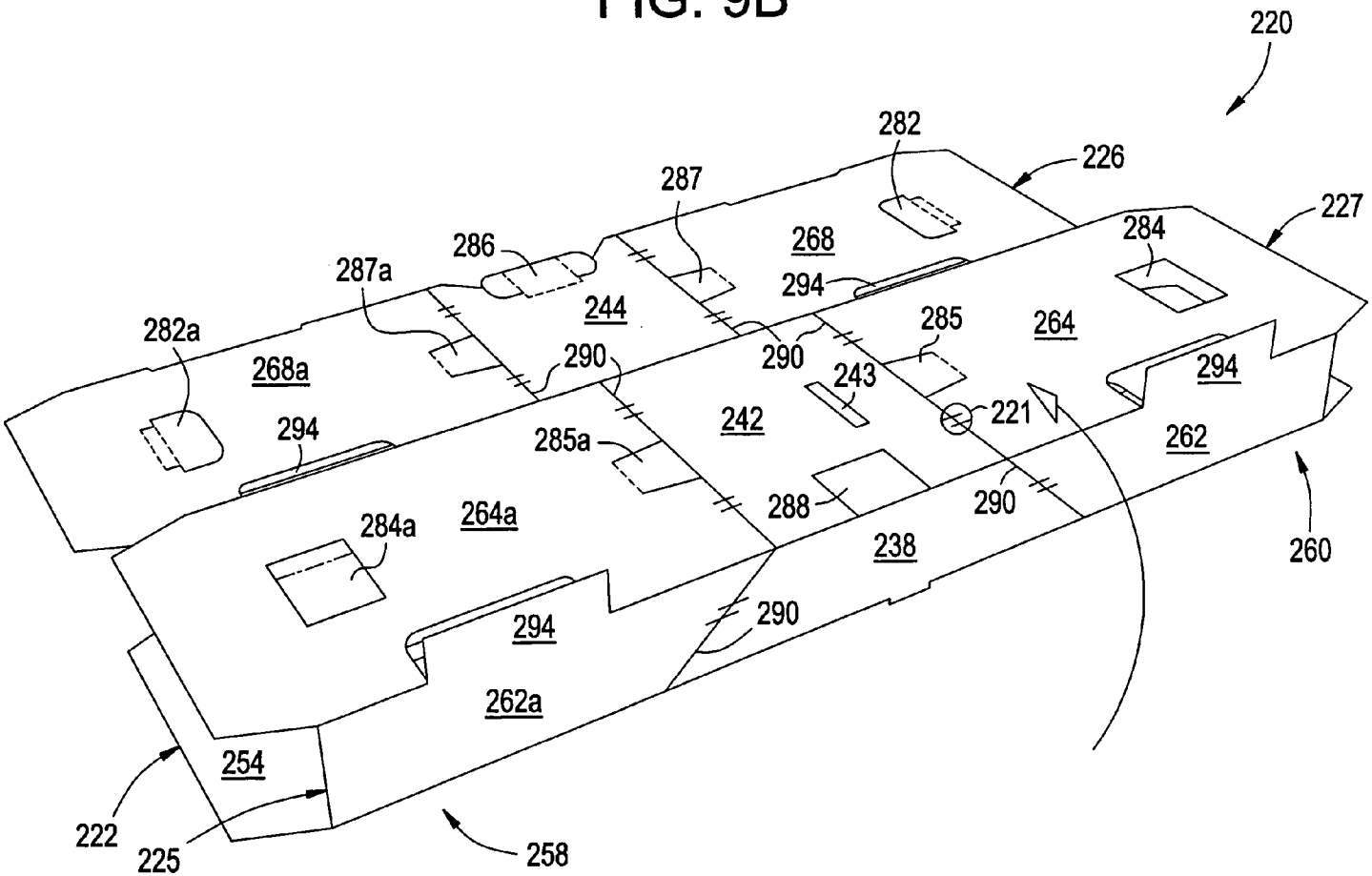
FIGS. 9B–9F are stop motion illustrating how the corrugated fibreboard blank of FIG. 9A is folded to form the insert of the second embodiment of the invention.

The use of the blank 220 (FIG. 9A) begins with FIG. 9B which is a first step where the side panel 225 is folded to stand perpendicular to the bottom panel 222. Then, the outer panel 227 is folded to be parallel to the bottom panel 222 and perpendicular to the side panel 225.

Figure 9C:
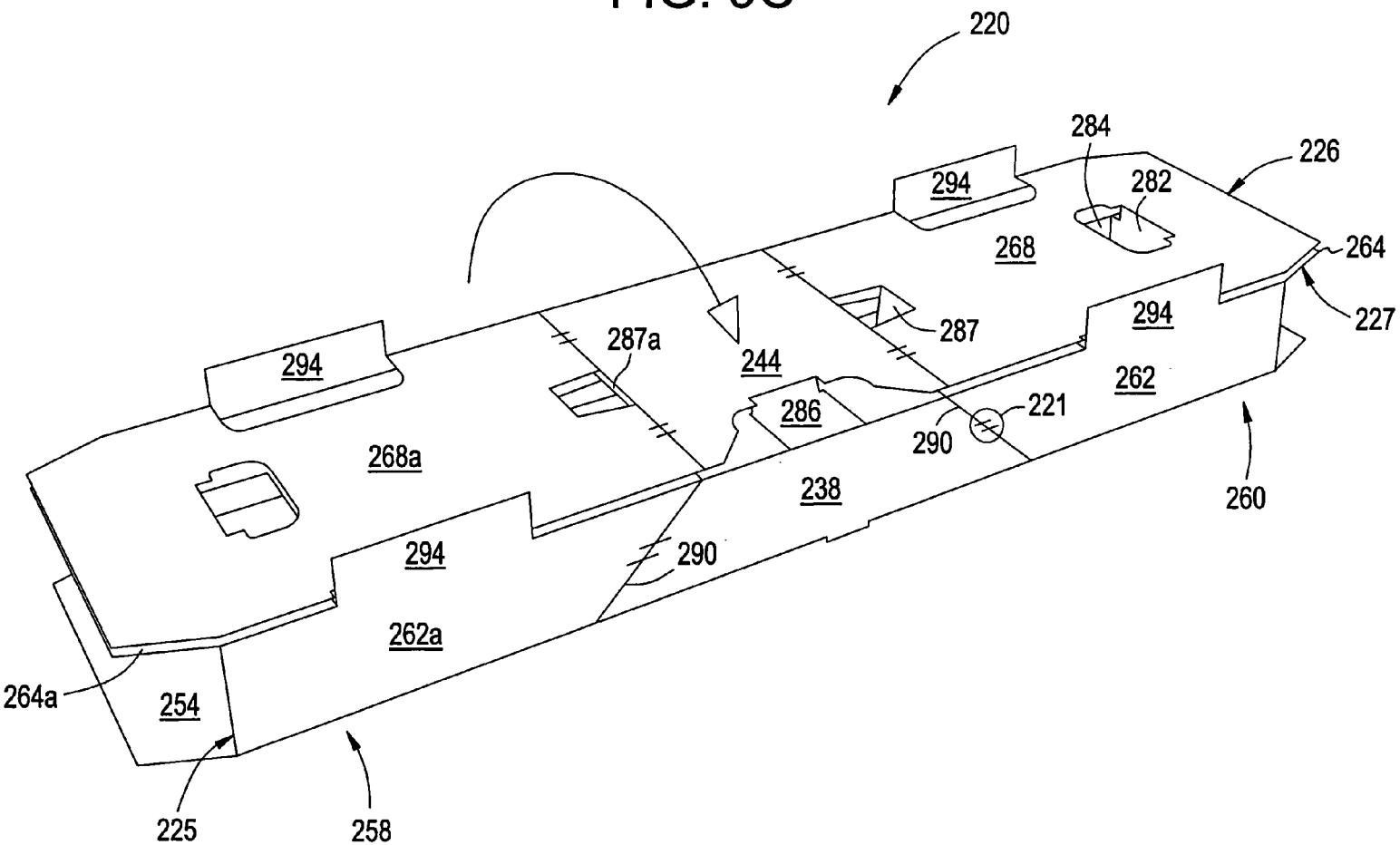

In FIG. 9C, the side panel 224 (not seen in FIG. 9C) is folded to stand perpendicular to the bottom panel 222. The outer panel 226 is folded to be perpendicular to the side panel 224, parallel to and in face-to-face contact with the outer panel 227 (see also FIG. 9B). The locking tab 286 is pushed into the locking hole 288 to secure the blank 220 in the folded configuration of FIG. 9C. The resulting structure is a generally tubular shaped structure.

It should be noted that the spacer tabs 294 are upstanding and have not folded over with the folding of the center panels 226, 227. It should also be noted that the lines 290 which were cut partially through by a knicked knife have held together so that the panels 222–227 folded as a unit and did not break apart through the folding of FIGS. 9B and 9C.

Figure 9D:
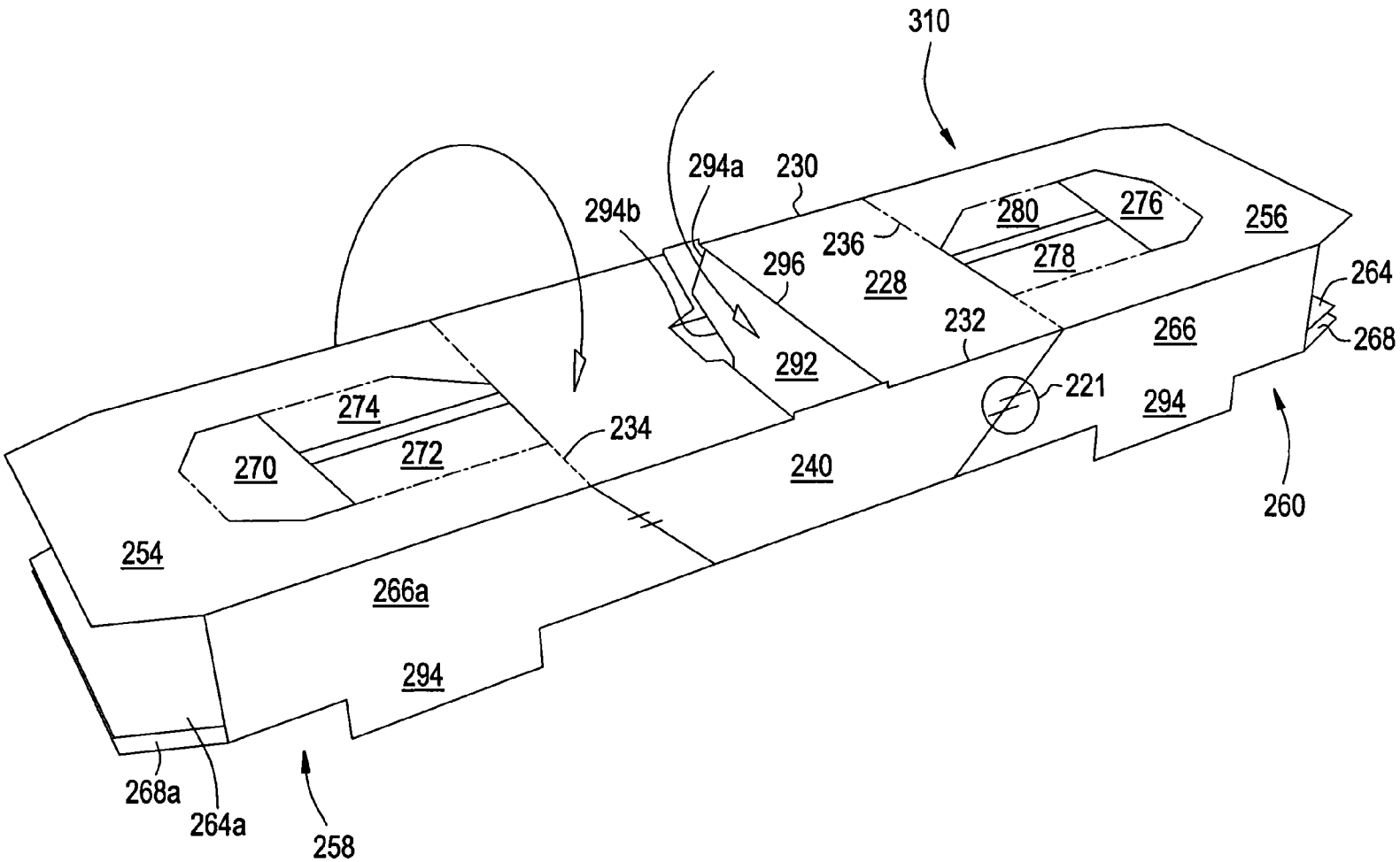
Figure 9E:
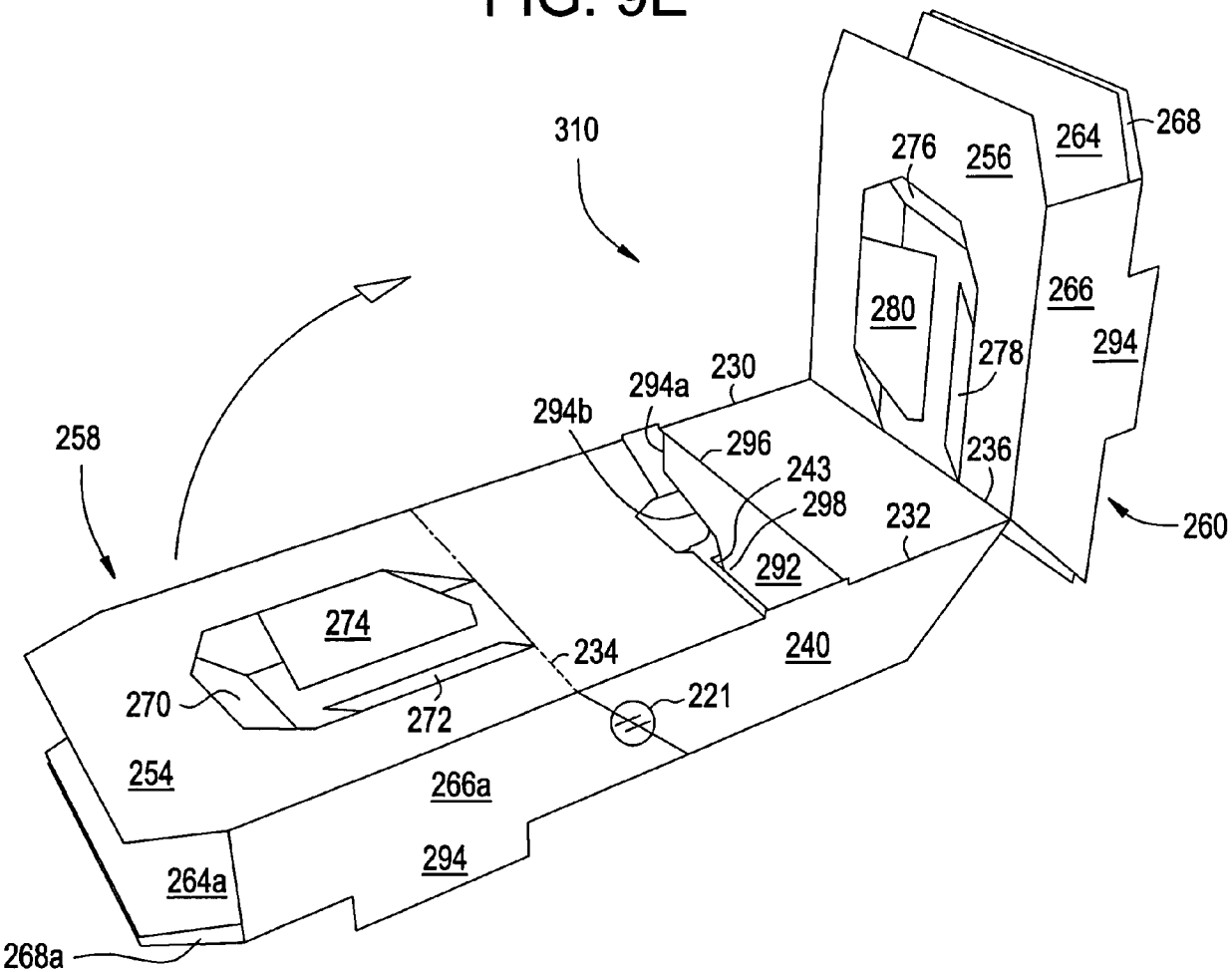

In FIG. 9D, the blank folded in FIG. 9C is flipped over so that the bottom panel 222 is on top and the outer panel 226 is on the bottom. The panel 292 is also pushed down toward the bottom air cell panel 242 until the tab portion 298 of the panel 292 is inserted into and locked within the hole 243 of the bottom air cell panel 242. The purpose of the panel 292 being locked within the hole 243 is to stabilize the bottom air cell to ensure that the bottom air cell of the insert 310 maintains its shape, preventing the insert 310 from swaying from side to side. If the panel 292 is not locked into the hole 243, the bottom air cell panel 242 and the bottom air cell, which is provided between the bottom air cell panel 242 and the bottom panel 228, has a tendency to collapse.

Then (FIG. 9E), the end 260 is folded up. The lines 290 partially cut by knicked knives were strong enough to remain intact during the folding and flipping of FIGS. 9B–9D, but are not strong enough to resist the folding of the air cell at end 260.

Figure 9F:
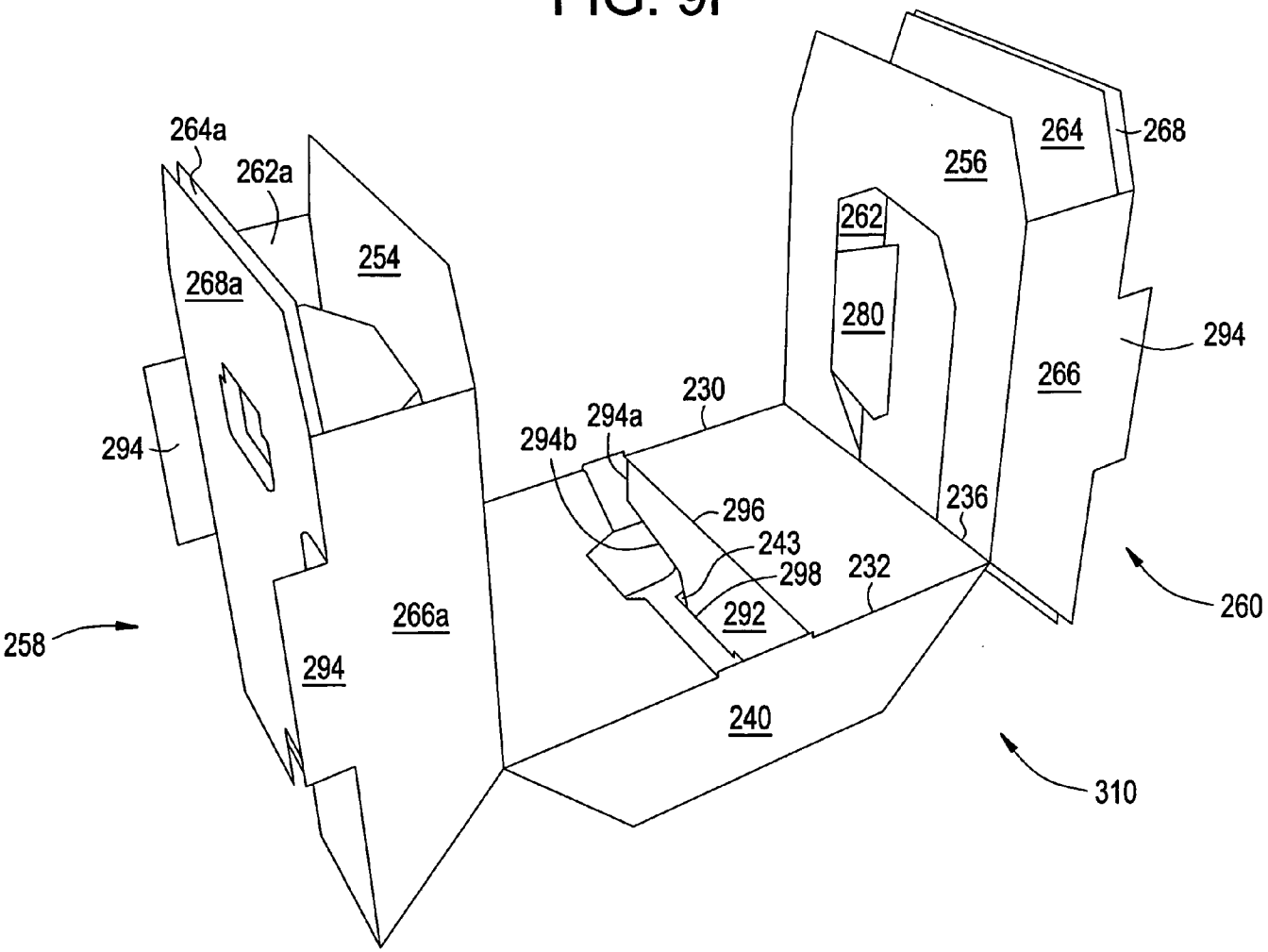

In FIG. 9F, the folding is complete when the air cell at end 258 is folded and standing approximately perpendicular to the center bottom panel 228 and parallel to the air cell at end 260. As can be seen in FIG. 9F, the insert 310 is a generally U-shaped structure when in its final form. The product anchoring tabs 270–280 are pushed in, and ready to receive the product 100. The locking tab 286 is pressed through the locking hole 288 in the same manner as the locking tab 86 is pressed through the locking hole 88 of the first embodiment of the insert, as illustrated in FIG. 4. The locking tab 286 being pressed through the locking hole 288 thus lock the panels 242, 244 in an assembled position.

Locking tab 282 is pressed through locking hole 284 to lock panels 264, 268 together in the same manner in which locking tab 82 is pressed through locking hole 84 to lock panels 64, 68 together in the first embodiment of the insert, as illustrated in FIG. 5.

An air cell is formed on each end 258, 260 of the insert 310 formed by folded blank 220. The bottom edges of panels 268, 264 and 268*a*, 264*a* are locked together by pushing somewhat keystone shaped panels 285, 287 and 285*a*, 287*a* inwardly. This is done in identical fashion as in the first embodiment of the insert as illustrated in FIG. 6.

After the air cells are formed on each of the opposite ends and the bottom of the insert 310, the product 100 is placed on the bottom panel 228 and between the product anchor flaps 270, 272, 274 and 276, 278, 280. As the end air cells are brought together, the lower corners of the product 100 are captured as they force the anchor flaps 270–274 and 276–280 outwardly. While this is not illustrated in the drawings, it is identical to that as shown in FIG. 7 with regard to the first embodiment of the insert.

Preferably, the toner cartridge is placed inside a plastic bag 130 when the packaging is complete. The assembled insert 310 and product 100 is now ready to be slid or placed in an outer box or carton in the same manner described in connection with the insert of the first embodiment of the invention, and as illustrated in FIG. 8, and therefore this discussion with not be repeated and reillustrated for brevity purposes.

Attention is invited to the third embodiment of the invention which is directed to a corrugated fibreboard blank 420 (FIG. 10A) which may be folded and adhered together to form an insert 510 for receiving and protecting a product 100. Dot-dashed lines show where the blank 420 folds. Solid lines show where the blank 420 is cut. Hash marks, such as shown at 421, identify lines which are partially or almost cut through, as by knicked knives, so that they will initially fold as a unit, but will break apart when the blank 420 reaches a final fold. These partially cut lines 421 divide the blank 420 into three parts which will become a central air cell having a cradle air cell on each end.

A generally rectangular and integrally formed blank 420 is divided longitudinally into a bottom panel 422 flanked by side panels 424, 425 joined to outer panels 426, 427. The bottom panel 422 has a rectangular central bottom panel 428 with opposite sides at fold lines 430, 432 and ends 434, 436. The side panels 424, 425 have splayed panels 438, 440 joined to the central bottom panel 428.

The central bottom panel 428 has a panel 492 provided therein which is defined by solid lines 494*a*, 494*b*, 494*c*, which as defined above is where the blank 420 is cut, and by a dot-dashed line 496, which as defined above is where the blank 420 is folded. The solid line 494*a* is provided along a portion of the fold line 430 and solid line 494*c* is provided along a portion of the fold line 432. The solid line 494*b* extends from one end of the solid line 494*a* to one end of the solid line 494*c*. The dot-dashed line 496 extends from an opposite end of the solid line 494*a* to an opposite end of the solid line 494*c*. The solid line 494*b* further defines a tab portion 498 of the panel 492. The purpose of the panel 492 and of the tab portion 498 of the panel 492 will be discussed further herein in connection with the formation of the insert 510 of the third embodiment from the blank 420.

The side panels 424, 425 are joined to the outer panels 426, 427 which have bottom air cell panels 442, 444 joined to the splayed panels 438, 440. The splayed panels 438, 440 and the bottom air cell panels 442, 444 will fold to form an air cell below the central bottom panel 428. The bottom air cell panel 442 has a hole 443 provided therethrough. The bottom air cell panel 440 has a notch 441 provided therethrough. The hole 443 and the notch 441 are sized and positioned such that upon formation of the insert 510 of the third embodiment, the hole 443 and the notch 441 can receive and lock the tab portion 498 of the panel 492 therein in order to hold the panel 492 in place, as will be discussed further herein.

A central cradle panel 454, 456 is formed at each end of the central bottom panel 428. The side panels 424, 425 and the outer panel 426, 427 have intermediate and outer cradle panels 462, 464 and 466, 468, respectively, which fold to form an air cell behind the central cradle panels 454, 456. Similar cradle panels (identified by the suffix (a)) are formed on the opposite ends of the outer panels 426, 427. Therefore, air cells are formed on each end and at the bottom of the insert formed by blank 420. Product anchoring tabs or flaps 470, 472, 474, 476, 478, 480 are formed on the central cradle panels 454, 456.

A fold line 433 is provided on the bottom panel 422 equidistantly from the fold lines 430 and 432. The fold line 433 extends through the central cradle panel 454, through the product anchoring tab 470, through the bottom panel 428, through the panel 492, through the product anchoring tab 476, and through the central cradle panel 456.

A fold line 435 is provided at the middle of the outer panel 427. The fold line 435 extends through the outer cradle panel 464*a*, the bottom air cell panel 442, and the outer cradle panel 464.

The outer panel 426 has a adhesive 483, such as a glue strip, provided thereon which extends over the middle of the outer panel 426. The adhesive 483 extends over the outer cradle panel 468*a*, through the bottom air cell panel 444, and through the outer cradle panel 468.

The intermediate cradle panels 462, 466 and the outer cradle panels 464, 468 will fold to form an air cell behind the central cradle panels 454, 456. In greater detail, the outer cradle panels 464, 468 fold and are positioned parallel to, behind, and spaced from the central cradle panel 456. The outer cradle panels 464, 468 are in face to face contact. Prior thereto, they are locked together when the blank 420 is folded along the fold lines 433, 435 such that the adhesive 483 secures the outer panel 426 to the outer panel 427.

The splayed panels 438, 440 and their bottom air cell panels 442, 444 are separated from the intermediate cradle panels 462, 466 and from their outer cradle panels 464, 468 by lines 490 which are partially cut by knicked knives, as indicated by twin hash marks such as those shown at 421. That is to say, the corrugated fibreboard is almost, but not quite, cut through.

Three product anchor flaps or tabs 470, 472, 474 and 476, 478, 480 are formed in the central cradle panels 454, 456 on opposite ends 458, 460 of the bottom panel 422. Preferably, these anchor flaps 470, 472, 474, 476, 478, 480 have an irregular shape in order to accommodate different end profiles of the product packaged in the cartridge insert. In greater detail, these flaps 470, 472, 474, 476, 478, 480 push out to receive and hold lower corners of the product 100. By a selection of these irregular shapes, it is possible to design one insert to receive, for instance, three different cartridges.

Figure 10B:
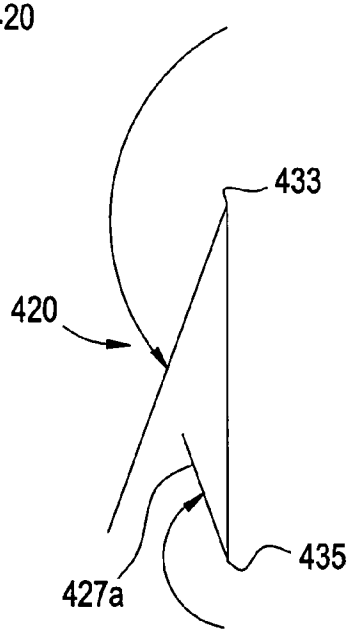
FIGS. 10B–10F are stop motion illustrating how the corrugated fibreboard blank of FIG. 10A is folded to form the insert of the third embodiment of the invention.
Figure 10A:
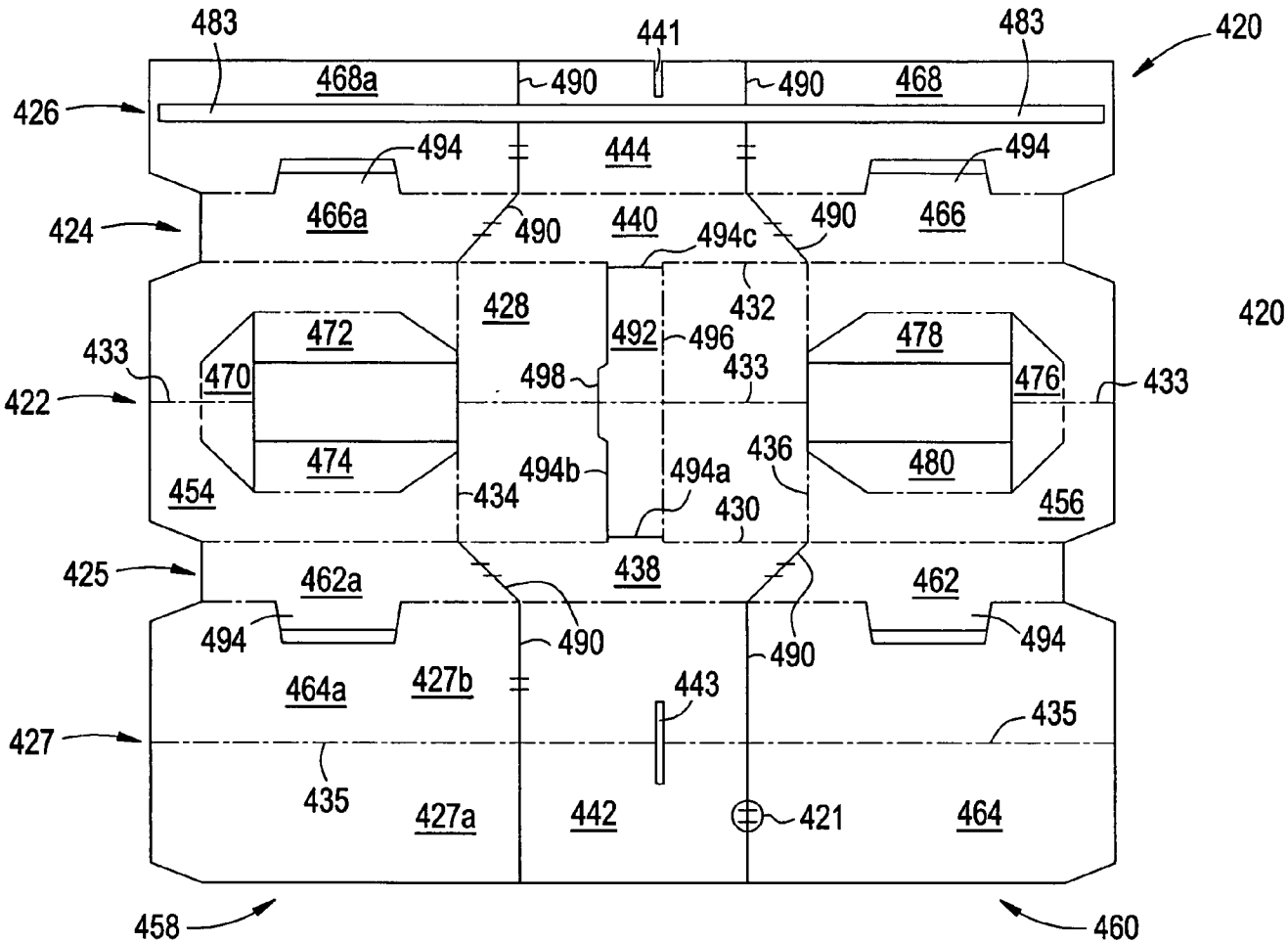
FIG. 10A is a perspective view of a corrugated fibreboard blank which is used for the formation of the insert of a third embodiment of the invention.

The use of the blank 420 (FIG. 10A) begins with folding the blank 420, as illustrated in FIG. 10B, along the fold line 435 such that the outer panel 427 is folded into two parts 427*a*, 427*b* with part 427*a* being folded over on top of part 427*b*. The blank 420 is then folded along the fold line 433 such that the outer panel 426 having the adhesive 483 thereon comes into contact with the part 427*a* of the outer panel 427, and such that the notch 441 is in communication with the hole 443. The adhesive 483 thus secures the outer panel 426 to the part 427*a* of the outer panel 427*a*. The blank 420 is thus formed into the flat configuration illustrated in FIG. 10C.

Figure 10C:
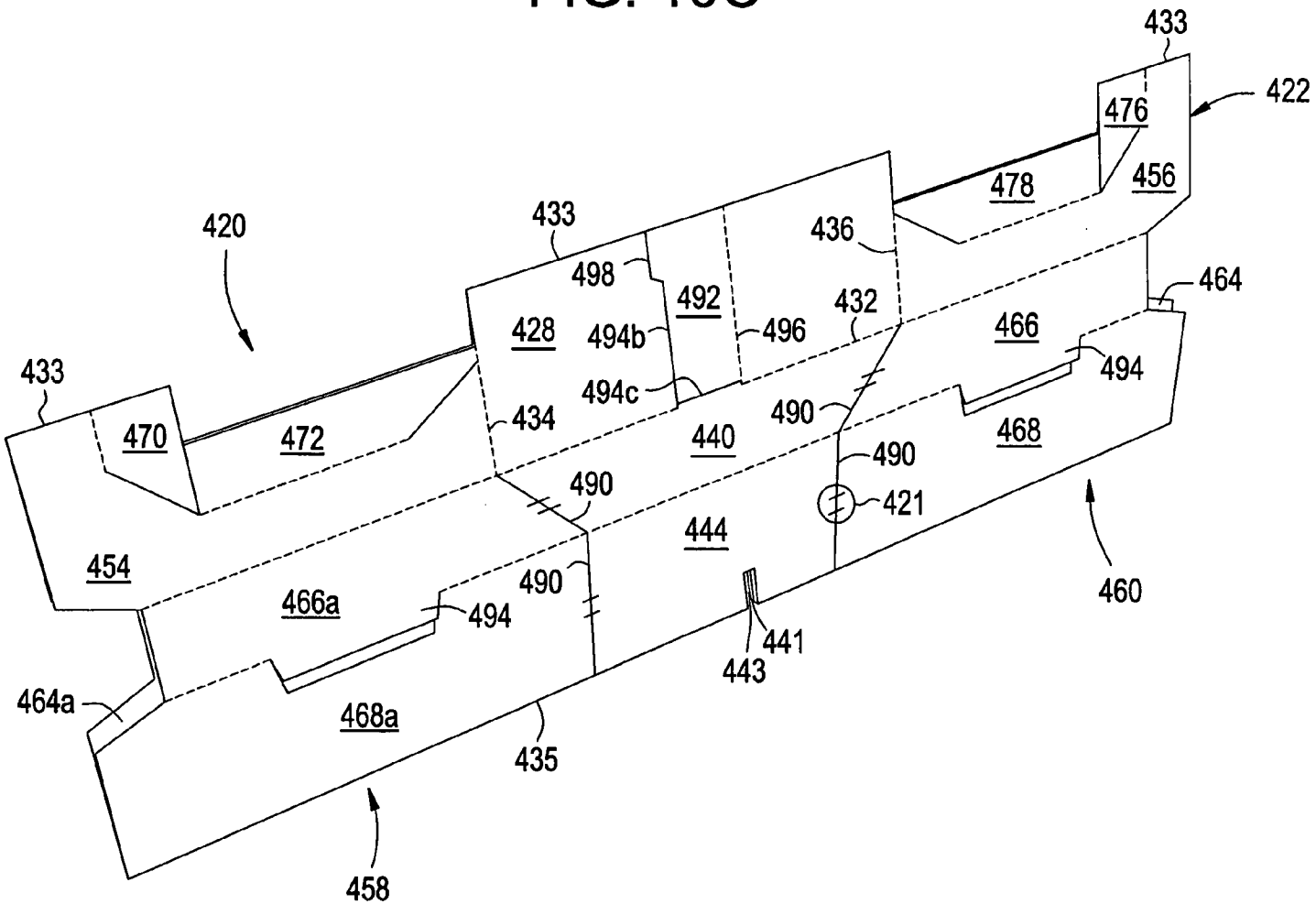
Figure 10D:
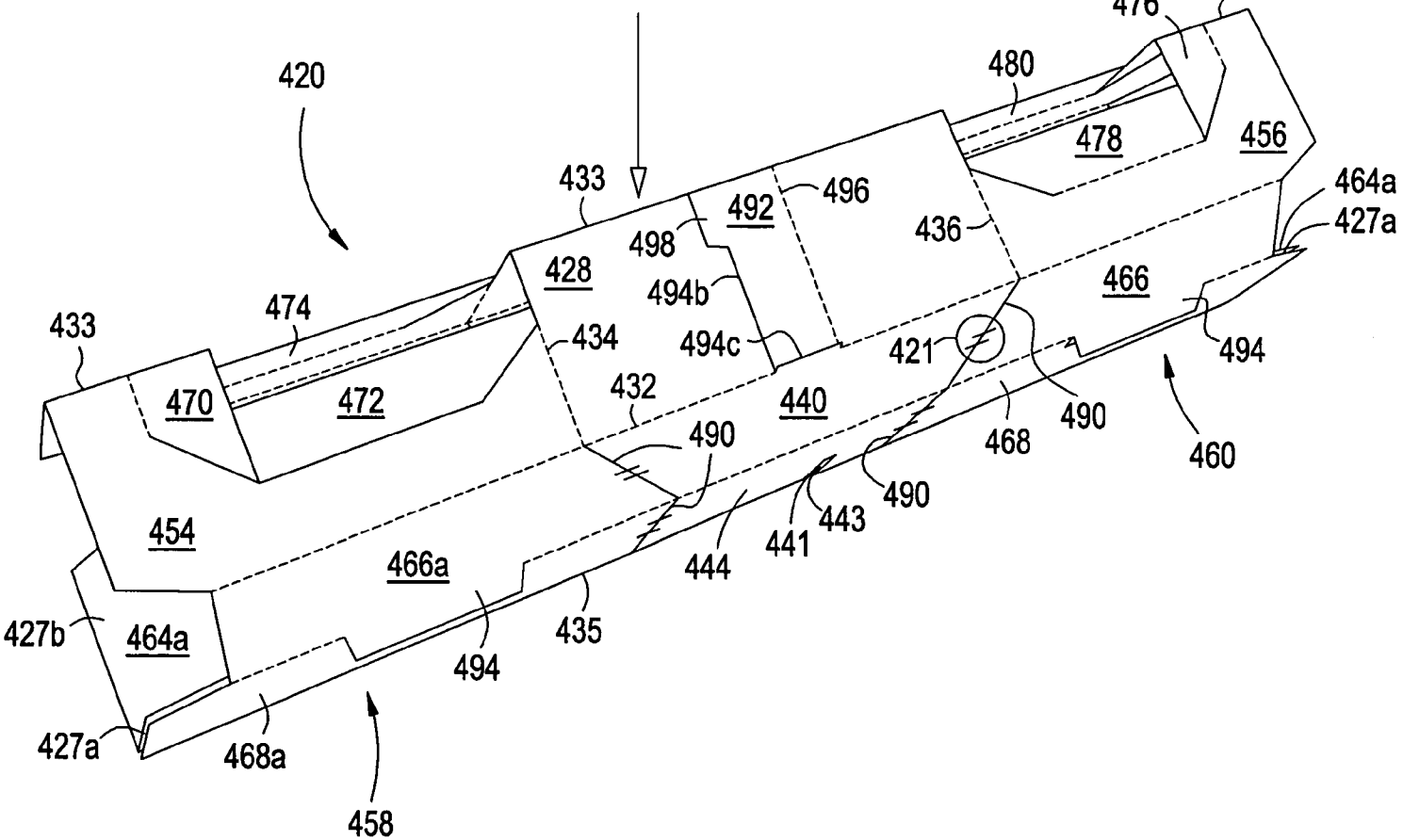

In FIG. 10D, the blank 420 is pushed downwardly along the fold line 433 such that the tubular insert 510 is formed by the blank 420 being folded along the fold lines 430, 432, and the fold lines separating the outer panels 426, 427 from the side panels 424, 425, respectively. Thus, the side panel 424 (not seen in FIG. 10D) is folded to stand perpendicular to the bottom panel 422. The outer panel 426 is folded to be perpendicular to the side panel 424, parallel to and in face-to-face contact with the outer panel 427. The blank 420 is secured in the folded configuration of FIG. 10D because of the adhesive 483 of the outer panel 426 being secured to the part 427*a* of the outer panel 427. The resulting structure is a generally tubular shaped structure.

It should be noted that the spacer tabs 494 are upstanding and have not folded over with the folding of the center panels 426, 427. It should also be noted that the lines 490 which were cut partially through by a knicked knife have held together so that the panels 422–427 folded as a unit and did not break apart through the folding of FIGS. 10C and 10D.

Figure 10E:
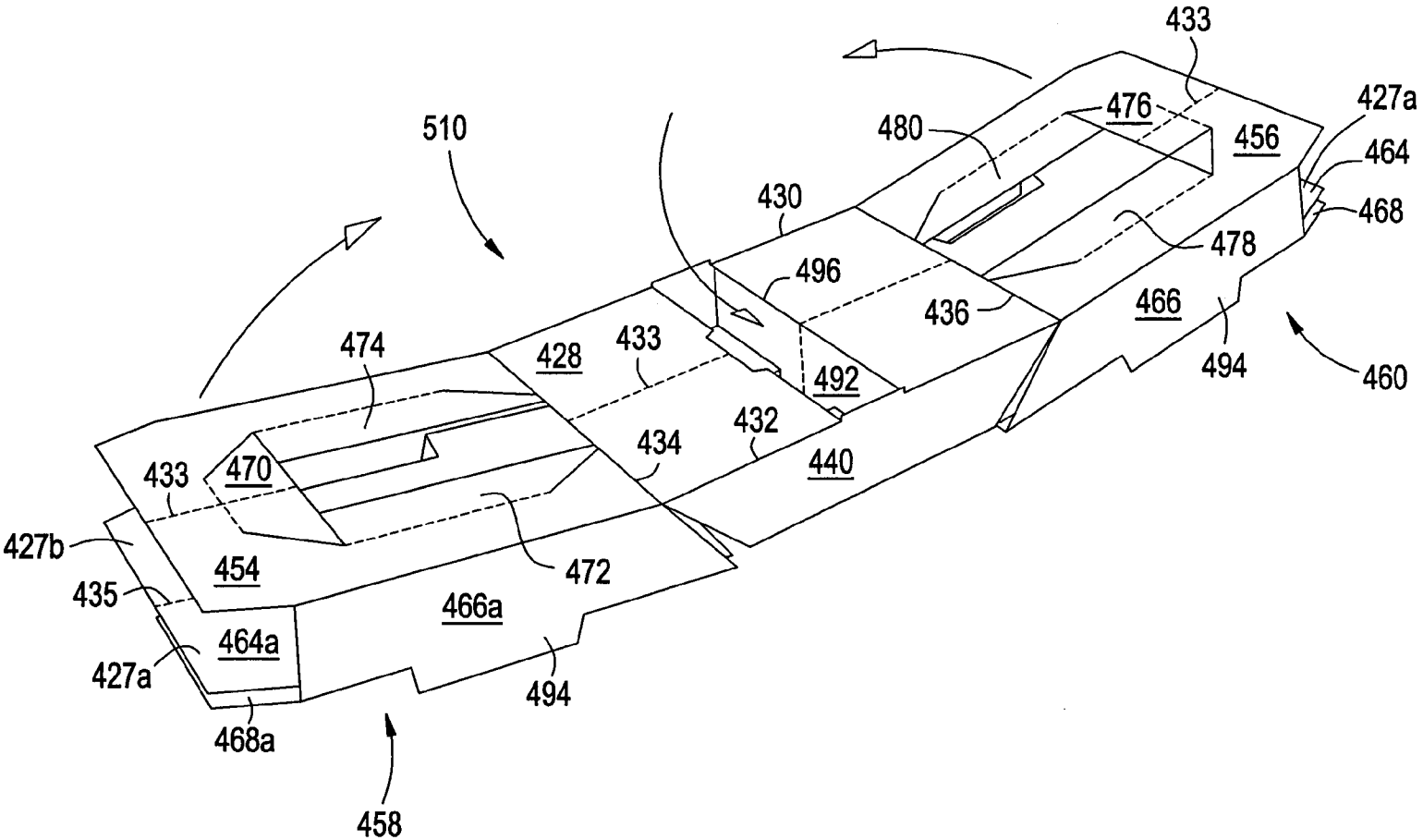

In FIG. 10E, the panel 492 is pushed down toward the bottom air cell panel 442 until the tab portion 498 of the panel 492 is inserted into and locked within the hole 443 of the bottom air cell panel 442 and the notch 441 of the bottom air cell panel 444. The purpose of the panel 492 being locked within the hole 443 and the notch 441 is to ensure that the bottom air cell of the insert 510 maintains its shape, preventing the insert 510 from swaying from side to side. If the panel 492 is not locked into the hole 443 and the notch 441, the bottom air cell panel 442 and the bottom air cell, which is provided between the bottom air cell panel 442 and the bottom panel 428, has a tendency to collapse.

As illustrated in FIG. 10E, the ends 458, 460 are also folded up. The lines 490 partially cut by knicked knives were strong enough to remain intact during the folding and flipping of FIGS. 10C–10D, but are not strong enough to resist the folding of the air cell at ends 458, 460.

Figure 10F:
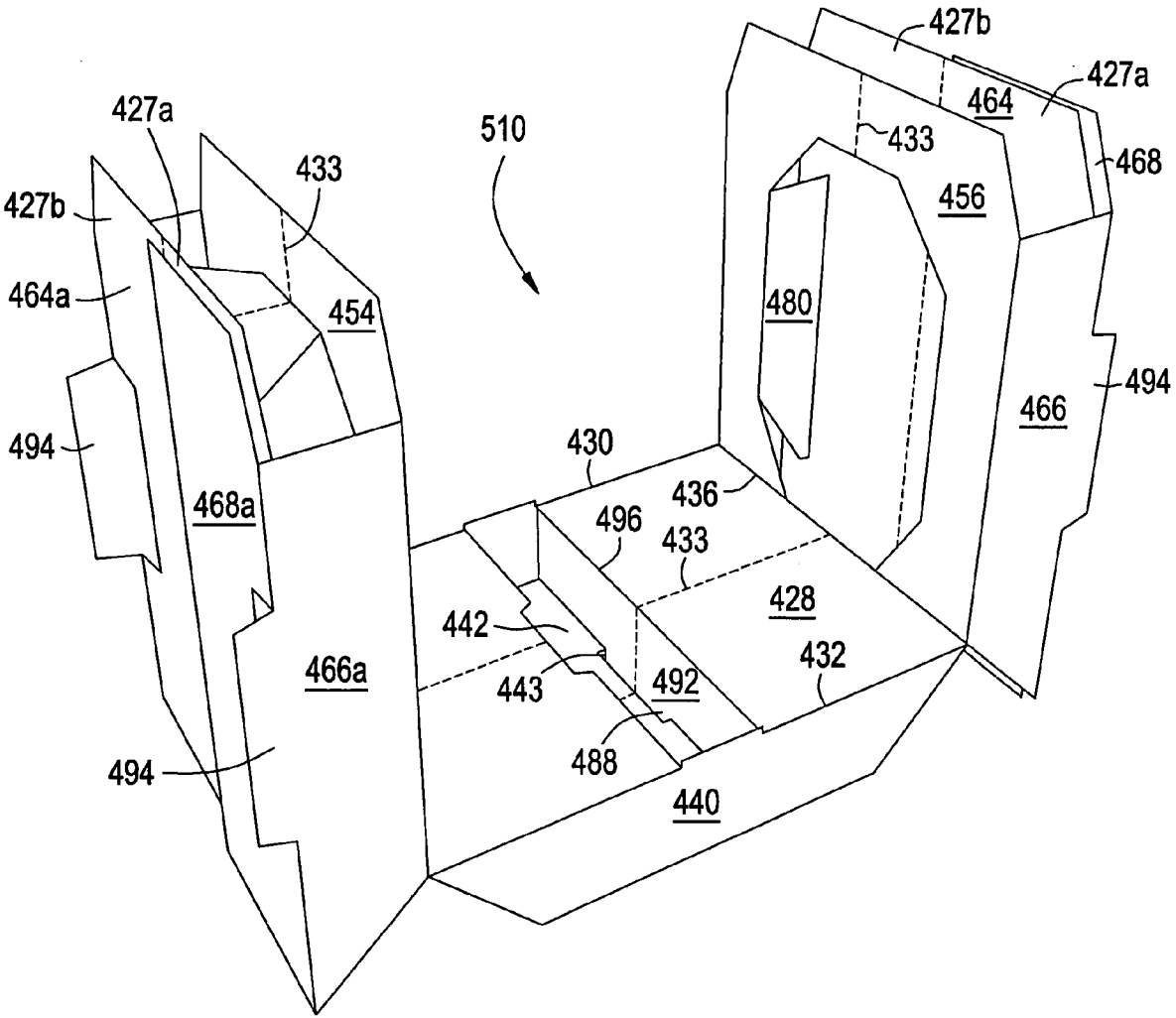

In FIG. 10F, the folding is complete when the air cell at end 458 is folded and standing approximately perpendicular to center bottom panel 428 and parallel to the air cell at end 460. As can be seen in FIG. 10F, the insert 510 is a generally U-shaped structure when in its final form. The product anchoring tabs 470–480 are pushed in, and ready to receive the product 100. An air cell is formed on each end of the insert 510 formed by the folded blank 420.

After the air cells are formed on each of the opposite ends 458, 460 and the bottom of the insert 510, the product 100 is placed on the bottom panel 428 and between the product anchor flaps 470, 472, 474 and 476, 478, 480. As the end air cells are brought together, the lower corners of the product 100 are captured as they force the anchor flaps 470–474 and 476–480 outwardly. While this is not illustrated in the drawings, it is identical to that as shown in FIG. 7 with regard to the first embodiment of the insert.

Preferably, the toner cartridge is placed inside a plastic bag 130 when the packaging is complete. The assembled insert 510 and product 100 is now ready to be slid or placed in an outer box or carton in the same manner described in connection with the insert of the first embodiment of the invention, and as illustrated in FIG. 8, and therefore this discussion with not be repeated and reillustrated for brevity purposes.

It should be noted that the blank 420 which forms the insert 510 of the third embodiment of the invention, could be formed without the panel 492 in the bottom panel 428, similar to the insert of the first embodiment of the invention.

It should further be noted that the blank 420 has the advantage of being shipped to a customer in an already partially formed insert. The blank 420 can be prepared by the manufacturer of the blank 420 to the configuration of the blank 420 as illustrated in FIG. 10C. Thus, the blank 420 can still be shipped flat to the customer and the customer does not need to do as many assembly steps prior to securing the product 100 into the insert 510 of the third embodiment. The gluing of the blank 20 also saves the manufacturer from extra costs involved in manually securing the anchoring tabs or flaps in the anchoring holes. In other words, once the customer receives the blank 420, the customer need only perform the steps illustrated in FIGS. 10D–10F.

All of the blanks 20, 220, 420 have a number of features and advantages. For instance, the blanks 20, 220, 420 allow for fast and easy assembly and handling, they provide for space-saving as they ship and store flat, they are inexpensive as they are formed of corrugated fibreboard, they are versatile as each insert formed from the blanks 20, 220, 420 can secure up to five different cartridges, they are environmentally friendly as they are formed of recyclable material, and they replace molded insert products, which are typically in foam and plastic.

While preferred embodiments of the present invention are shown and described, it is envisioned that those skilled in the art may devise various modifications of the present invention without departing from the spirit and scope of the appended claims.

The invention is claimed as follows:

1. An insert formed from a corrugated fibreboard blank for receiving and protecting a product, said insert comprising:

a first side panel associated with a first side air cell which is configured to protect the product, said first side panel configured to receive a first end of the product when the product comes into contact with said first side panel;

a second side panel associated with a second side air cell which is configured to protect the product, said second side panel configured to receive a second end of the product when the product comes into contact with said second side panel; and a bottom panel associated with a bottom air cell which is configured to protect the product, said bottom panel configured to prevent the product from extending into said bottom air cell.

2. The insert as defined in claim 1, further comprising at least one spacer tab extending outwardly from said first side air cell opposite said first side panel and at least one spacer tab extending outwardly from said second side air cell opposite said second side panel, each said spacer tab configured to provide protection to said first and second side air cells when said insert is packed inside of a box.

3. The insert as defined in claim 1, wherein said bottom panel has a panel which is configured to be folded into said bottom air cell in order to stabilize said bottom air cell.

4. The insert as defined in claim 3, wherein said panel of said bottom panel has a tab portion thereon, and wherein said bottom air cell has a hole associated therewith, said tab portion of said panel of said bottom panel configured to be inserted and locked into said hole associated with said bottom air cell.

5. The insert as defined in claim 1, wherein each of said air cells of said insert are formed by folding the corrugated fibreboard blank and by securing a first portion of the corrugated fibreboard blank to a second portion of the corrugated fibreboard blank with an adhesive.

6. The insert as defined in claim 1, wherein each of said air cells of said insert are formed by folding the corrugated fibreboard blank and by inserting locking tabs of the corrugated fibreboard blank into holes of the corrugated fibreboard blank.

7. An insert as defined in claim 1, wherein said bottom air cell is defined at both a top and a bottom thereof by portions of the corrugated fibreboard blank.

8. An insert as defined in claim 1, wherein said bottom panel is configured to be suspended between said first and second side panels.

9. An insert formed from a corrugated fibreboard blank for receiving and protecting a product, said insert comprising:

p1 a first side panel associated with a first side air cell which is configured to protect the product, said first side panel configured to receive a first end of the product therein when the product comes into contact with said first side panel;

a second side panel associated with a second side air cell which is configured to protect the product, said second side panel configured to receive a second end of the product therein when the product comes into contact with said second side panel; and a bottom panel associated with a bottom air cell which is configured to protect the product, said first side panel and said first side air cell are configured to fold outwardly or inwardly relative to said bottom panel and said bottom air cell in order to adjust to different sizes of the product.

10. The insert as defined in claim 9, wherein said second side panel and said second side air cell are configured to fold outwardly or inwardly relative to said bottom panel and said bottom air cell in order to adjust to different sizes of the product.

11. A method of forming an insert which is used for receiving and protecting a product, said method comprising the steps of:

providing a blank having anchoring tabs;

folding a first portion of said blank over onto a second portion of said blank;

securing said first portion of said blank to said second portion of said blank to form said blank into a generally tubular structure which is separated into a first air cell, a second air cell and a third air cell;

folding said first air cell generally perpendicularly to said second air cell, at least one of said anchoring tabs of said blank being associated with said first air cell; and folding said third air cell generally perpendicularly to said second air cell such that said third air cell faces said first air cell, at least one of said anchoring tabs of said blank being associated with said third air cell.

12. A method as defined in claim 11, further comprising the steps of:

providing said blank with an adhesive on said first portion thereof; and securing said first portion of said blank to said second portion of said blank with said adhesive.

13. A method as defined in claim 11, further comprising the steps of:

providing said blank with at least one locking tab and at least one hole for receiving said at least one locking tab; and inserting said at least one locking tab into said at least one hole in order to secure said first portion of said blank to said second portion of said blank.

14. A method as defined in claim 11, further comprising the steps of:

providing said blank with a panel such that when said panel is folded said panel is associated with said second air cell; and folding said panel into said second air cell in order to stabilize said second air cell.

15. A method of securing a product within an insert, said method comprising the steps of:

providing the insert which is formed from a blank, the insert having a first side panel associated with a first side air cell, a second side panel associated with a second side air cell, and a bottom panel associated with a bottom air cell, said first side panel being at least partially joined to said bottom panel, said second side panel being at least partially joined to said bottom panel, said first and second side panels being foldable relative to said bottom panel;

providing said first side panel with at least one anchoring tab;

providing said second side panel with at least one anchoring tab;

positioning the product on said bottom panel of the insert;

folding said first side panel until a first end of the product pushes against said at least one anchoring tab of said first side panel such that said at least one anchoring tab of said first side panel is folded into said first side air cell and such that said first end of the product is secured within said first side air cell; and folding said second side panel until a second end of the product pushes against said at least one anchoring tab of said second side panel such that said at least one anchoring tab of said second side panel is folded into said second side air cell and such that said second end of the product is secured within said second side air cell.

16. A method as defined in claim 15, wherein said first side panel is at least partially joined to said bottom panel along partially cut lines formed in said blank, and wherein said second side panel is at least partially joined to said bottom panel along partially cut lines formed in said blank.

17. A method of forming an insert for receiving and protecting a product, said method comprising the steps of:

providing a generally rectangular blank which is folded over onto itself and is secured to itself by an adhesive, said folded blank configured to lay flat such that it has a first end defined by a first fold line and a second end defined by a second fold line;

positioning said first fold line of said folded blank against a surface;

pushing down on said folded blank at said second fold line to form a tubular insert having first, second and third portions from said folded blank, said first portion of said tubular insert being connected to said second portion of said tubular insert and having at least one anchoring tab for receiving a first portion of the product therein, said third portion of said tubular insert being connected to said second portion of said tubular insert and having at least one anchoring tab for receiving a second portion of the product therein;

folding said first portion of said tubular insert relative to said second portion of said tubular insert; and folding said third portion of said tubular insert relative to said second portion of said tubular insert such that said at least one anchoring tab of said third portion of said tubular insert faces said at least one anchoring tab of said first portion of said tubular portion.

18. A method as defined in claim 17, wherein said first portion of said tubular insert is at least partially connected to said second portion of said tubular insert by a first partially cut fold line, and wherein said third portion of said tubular insert is at least partially connected to said second portion of said tubular insert by a second partially cut fold line.

19. An insert formed from a corrugated fibreboard blank for receiving and protecting a product, said insert comprising:

a first side panel associated with a first side air cell which is configured to protect the product, said first side panel having at least one anchor tab which is configured to be folded into said first side air cell when a first end of the product comes into contact with said first side panel;

a second side panel associated with a second side air cell which is configured to protect the product, said second side panel having at least one anchor tab which is configured to be folded into said second side air cell when a second end of the product comes into contact with said second side panel; and a bottom panel associated with a bottom air cell which is configured to protect the product.

20. An insert formed from a corrugated fibreboard blank for receiving and protecting a product, said insert comprising:

a first side panel associated with a first side air cell which is configured to protect the product, said first side panel configured to receive a first end of the product therein when the product comes into contact with said first side panel:

a second side panel associated with a second side air cell which is configured to protect the product, said second side panel configured to receive a second end of the product therein when the product comes into contact with said second side panel; and a bottom panel associated with a bottom air cell which is configured to protect the product, said bottom air cell being defined by said bottom panel, a first panel, a second panel and a third panel, each of which are provided in the corrugated fibreboard blank, said second panel connects said bottom panel to said first panel, said third panel connects said bottom panel to said first panel, said second and third panels being separated from one another.

21. An insert as defined in claim 20, wherein said bottom panel and said first panel are generally parallel to one another, and wherein said second panel and said third panel are generally parallel to one another.

22. An insert as defined in claim 20, wherein said first panel includes a pair of bottom air cell panels, and wherein said second and third panels are splayed panels.

23. An insert for receiving, cradling, and protecting a product, said insert comprising:

a corrugated fibreboard blank divided by fold and cut lines to enable the blank to be folded into a cradle configuration, said folding forming a bottom panel over an associated bottom air cell and a pair of vertical cradle panels with an associated vertical cradle air cell on each end of said bottom panel; and product anchoring tabs on said pair of vertical cradle panels for securing a product in place between said vertical cradle panels and said bottom air cell.

24. An insert as defined in claim 23, wherein said vertical cradle panels and their associated vertical cradle air cells fold slightly outwardly or inwardly relative to said bottom air cell in order to adjust to different lengths of the product.

25. An insert as defined in claim 24 and an outer box for receiving said insert and for fixing a distance between the outwardly or inwardly folded vertical cradle panels.

26. An insert as defined in claim 25 and spacer tabs on each of said vertical cradle panel adjacent air cells for forming additional air cells between said adjacent air cells and end walls of said outer box.

27. An insert as defined in claim 23, wherein said insert is formed and stabilized into said cradle configuration by use of only said corrugated fibreboard blank.

28. An insert as defined in claim 23, wherein said bottom air cell is bounded at a top thereof by said bottom panel and is bounded at a bottom thereof by a portion of said corrugated fibreboard blank.

29. A corrugated fibreboard blank for forming a structure to receive and protect a toner cartridge for a printer, said structure being formed by folding an integral generally rectangular corrugated fibreboard blank in order to form a cradle configuration for receiving ends and for supporting a bottom surface of the toner cartridge;

said cradle being formed of three integrally formed air cells, which are joined to provide two end cells and a central cell positioned between said two end cells;

said central air cell having a bottom panel for supporting the bottom surface of the toner cartridge; and said two end air cells having anchoring flaps which receive opposite ends of the toner cartridge.

30. The insert of claim 29, wherein said corrugated fibreboard blank is divided by fold and cut lines to enable the integral blank to be folded into the structure;

said folding forming said bottom panel over said central air cell and a vertical cradle panel for each of said two end air cells, said vertical cradle panels being joined to opposite ends of said bottom panel, respectively; and said anchoring flaps being on said vertical panels for securing said ends of the toner cartridge in place within the structure.

31. A blank for cradling a product, said blank comprising:

a longitudinal bottom panel flanked by side panels joined to outer panels;

said longitudinal bottom panel having opposite ends with a central cradle panel joined to and extending from each of said opposite ends of said longitudinal bottom panel;

each of said side panels comprises a centrally located splayed panel positioned between outer portions of said side panel, said centrally located splayed panel connected to a side of said longitudinal bottom panel, each of said outer panels having a centrally located bottom air cell panel joined to and extending from said splayed panel; and an outer cradle panel connected to each of said outer portions of each said side panel and adjacent said bottom air cell panels.

32. A blank as defined in claim 31 and product anchor tabs on each said central cradle panel.

33. A blank as defined in claim 31, wherein said side panels are configured to fold generally perpendicular to said bottom panel and said outer panels configured to fold into face to face contact over said bottom panel thereby forming a tubular structure.

34. A blank as defined in claim 33, wherein said tubular structure is divided into three parts.

35. A blank as defined in claim 34, wherein partially cut lines divide said tubular structure into said three parts.

36. A blank as defined in claim 35, wherein said partially cut lines enable said folding of said blank into said tubular structure.

37. A blank as defined in claim 36, wherein said partially cut lines break apart responsive to folding said tubular structure into a somewhat U-shaped structure.

38. A blank as defined in claim 34, wherein said three parts are configured to be folded relative to one another in order to fold said tubular structure into a somewhat U-shaped structure.

39. An insert formed from a corrugated fibreboard blank for receiving and protecting a product, said insert comprising:

a first side panel associated with a first side air cell which is configured to protect the product, said first side panel configured to receive a first end of the product therein when the product comes into contact with said first side panel;

a second side panel associated with a second side air cell which is configured to protect the product, said second side panel configured to receive a second end of the product therein when the product comes into contact with said second side panel; and a bottom panel associated with a bottom air cell which is configured to protect the product, said first side panel and said first side air cell are configured to fold outwardly relative to said bottom panel and said bottom air cell upon receiving the product in order to adjust to different sizes of the product.

40. An insert formed from a corrugated fibreboard blank for receiving and protecting a product, said insert comprising:

a first side panel associated with a first side air cell which is configured to protect the product, said first side panel configured to receive a first end of the product therein when the product comes into contact with said first side panel;

a second side panel associated with a second side air cell which is configured to protect the product, said second side panel configured to receive a second end of the product therein when the product comes into contact with said second side panel; and a bottom panel associated with a bottom air cell which is configured to protect the product, whereby upon said first and second side panels receiving the product, said bottom panel is not pressed downwardly into said bottom air cell and said first and second side panels are not pulled toward one another.

41. An insert formed from a corrugated fibreboard blank for receiving and protecting one of a first and second product, wherein the first product has a shape and configuration which is different than the second product, said insert comprising:

a first side panel associated with a first side air cell which is configured to protect either the first or second product, said first side panel configured to receive a first end of either the first or second product therein when either the first or second product comes into contact with said first side panel;

a second side panel associated with a second side air cell which is configured to protect either the first or second product, said second side panel configured to receive a second end of either the first or second product therein when either the first or second product comes into contact with said second side panel; and a bottom panel associated with a bottom air cell which is configured to protect either the first or second product.

* * * * *

UNITED STATES PATENT AND TRADEMARK OFFICE

CERTIFICATE OF CORRECTION

PATENT NO. : 7,021,024 B2
APPLICATION NO. : 10/689802
DATED : April 4, 2006
INVENTOR(S) : David F. Kari It is certified that error appears in the above-identified patent and that said Letters Patent is hereby corrected as shown below:

On the title page item (57) ABSTRACT Line 8 "cooperates" should be
-- cooperate --

Column 12, Line 1 "pl a first" should be -- a first --

Column 14, Line 14 " panel:" should be -- panel; --

Signed and Sealed this

Twenty-second Day of August, 2006

JON W. DUDAS
*Director of the United States Patent and Trademark Office*